US010724525B2

(12) United States Patent
Inada et al.

(10) Patent No.: US 10,724,525 B2
(45) Date of Patent: Jul. 28, 2020

(54) COMPRESSION MECHANISM FOR A COMPRESSOR

(71) Applicant: DAIKIN INDUSTRIES, LTD., Osaka-shi, Osaka (JP)

(72) Inventors: Yukihiro Inada, Osaka (JP); Kazuhiro Furusho, Osaka (JP); Eiji Kumakura, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 262 days.

(21) Appl. No.: 15/744,590

(22) PCT Filed: Jul. 12, 2016

(86) PCT No.: PCT/JP2016/003302
§ 371 (c)(1),
(2) Date: Jan. 12, 2018

(87) PCT Pub. No.: WO2017/010092
PCT Pub. Date: Jan. 19, 2017

(65) Prior Publication Data

US 2018/0202446 A1 Jul. 19, 2018

(30) Foreign Application Priority Data

Jul. 15, 2015 (JP) ..... 2015-141374

(51) Int. Cl.
*F03C 2/00* (2006.01)
*F03C 4/00* (2006.01)
(Continued)

(52) U.S. Cl.
CPC ..... *F04C 29/12* (2013.01); *F01C 21/02* (2013.01); *F04C 18/32* (2013.01); *F04C 18/322* (2013.01);
(Continued)

(58) Field of Classification Search
CPC ..... F04C 18/32; F04C 18/322; F04C 23/001; F04C 23/008; F04C 29/00; F04C 29/12;
(Continued)

(56) References Cited

U.S. PATENT DOCUMENTS

2011/0067434 A1 3/2011 Miura et al.
2012/0189482 A1* 7/2012 Kishikawa ..... F04C 18/356 418/179
2014/0219833 A1 8/2014 Kanayama et al.

FOREIGN PATENT DOCUMENTS

CN 2934666 Y 8/2007
JP 63-12689 U 1/1988
(Continued)

OTHER PUBLICATIONS

International Preliminary Report of corresponding PCT Application No. PCT/JP2016/003302 dated Jan. 25, 2018.
(Continued)

*Primary Examiner* — Theresa Trieu
(74) *Attorney, Agent, or Firm* — Global IP Counselors, LLP

(57) ABSTRACT

A compressor includes a compression mechanism having a ring-shaped first cylinder, a first piston eccentrically rotatable in an interior of the first cylinder, a first cylinder head member disposed adjacent to one axial end of the first cylinder, a second cylinder head member disposed adjacent to an other axial end of the first cylinder, and a fastening bolt. The fastening bolt fastens the first cylinder head member, the first cylinder, and the second cylinder head member together. An end face of the first cylinder head member contacts the first cylinder, and the end face is provided with a protecting groove. The protecting groove is formed closer to a center of the first cylinder than the
(Continued)

fastening bolt, and has a groove width smaller than a groove depth of the protecting groove.

14 Claims, 20 Drawing Sheets

(51) Int. Cl.

| | |
|---|---|
| ***F04C 2/00*** | (2006.01) |
| ***F04C 18/00*** | (2006.01) |
| ***F04C 29/12*** | (2006.01) |
| ***F04C 29/00*** | (2006.01) |
| ***F04C 18/32*** | (2006.01) |
| ***F01C 21/02*** | (2006.01) |
| ***F04C 23/00*** | (2006.01) |

(52) U.S. Cl.
CPC ..... *F04C 23/001* (2013.01); *F04C 29/00* (2013.01); *F04C 23/008* (2013.01); *F04C 2210/26* (2013.01); *F04C 2240/10* (2013.01); *F04C 2240/805* (2013.01)

(58) Field of Classification Search
CPC ..... F04C 2210/26; F04C 2240/10; F04C 2240/805; F01C 21/02
USPC ..... 418/11, 60, 63, 212, 249, 270, 210
See application file for complete search history.

(56) References Cited

FOREIGN PATENT DOCUMENTS

| | | | |
|---|---|---|---|
| JP | 63-186988 | U | 11/1988 |
| JP | 2-144689 | U | 12/1990 |
| JP | 2004-124834 | A | 4/2004 |
| JP | 2009-281325 | A | 12/2009 |
| JP | 2014-129761 | A | 7/2014 |

OTHER PUBLICATIONS

International Search Report of corresponding PCT Application No. PCT/JP2016/003302 dated Oct. 18, 2016.
European Search Report of corresponding EP Application No. 16 82 4077.8 dated Nov. 9, 2018.

* cited by examiner

COMPRESSION MECHANISM FOR A COMPRESSOR

CROSS-REFERENCE TO RELATED APPLICATIONS

This U.S. National stage application claims priority under 35 U.S.C. § 119(a) to Japanese Patent Application No. 2015-141374, filed in Japan on Jul. 15, 2015, the entire contents of which are hereby incorporated herein by reference.

TECHNICAL FIELD

This disclosure relates to a compressor, in particular, a rotary compressor.

BACKGROUND ART

Compressors which compress and discharge a fluid such as a refrigerant are known in the art. For example, Japanese Unexamined Patent Publication No. 2009-281325 discloses a compressor including a compression mechanism of an oscillating piston type. In this compressor, components, such as a cylinder and a cylinder head member, constituting the compression mechanism are axially stacked and bolted together.

SUMMARY

Technical Problem

In the compressor of Japanese Unexamined Patent Publication No. 2009-281325, bolting causes compression and deformation of a portion of the cylinder around the bolted position. This compression deformation of the cylinder also causes deformation of the cylinder head member such that a portion (facing the cylinder) of the outer periphery of the cylinder head member around the bolted position is deformed to be raised in the same direction as the direction in which the cylinder is compressed and deformed. This deformation in the bolted position may be transmitted toward the inner periphery (to a side closer to the center of the cylinder) to axially deform the central portion, facing the piston, of the cylinder head member. As a result, a gap length between the cylinder head member and the piston may be varied. Thus, it is difficult to keep an appropriate gap length between the cylinder head member and the piston.

It is therefore an object of the present disclosure to provide a compressor capable of reducing variation in a gap length between a cylinder head member and a piston due to bolting.

Solution to the Problem

A first aspect of the present disclosure is directed to a compressor including a compression mechanism (40) including a ring-shaped first cylinder (51), a first piston (52) rotating eccentrically in an interior of the first cylinder (51), a first cylinder head member (61) disposed adjacent to one axial end of the first cylinder (51), a second cylinder head member (62) disposed adjacent to the other axial end of the first cylinder (51), and a fastening bolt (70) fastening the first cylinder head member (61), the first cylinder (51), and the second cylinder head member (62) together. An end face of the first cylinder head member (61) contacting the first cylinder (51) is provided with a protecting groove (80), and the protecting groove (80) is formed to be closer to a center of the first cylinder (51) than the fastening bolt (70) is, and has a groove width (W) shorter than a groove depth (D) thereof.

According to the first aspect of the present disclosure, the end face of the first cylinder head member (61) contacting the first cylinder (51) is provided with the protecting groove (80). This allows the protecting groove (80) to absorb the deformation in the bolted position, and thus, the deformation in the bolted position is less likely to be transmitted to a region inside of the protecting groove (80) (a side closer to the center of the first cylinder (51) than the protecting groove (80) is). This can reduce the deformation in the center portion (the portion facing the first piston (52)) of the first cylinder head member (61).

According to the first aspect, making the groove width (W) of the protecting groove (80) shorter than the groove depth (D) of the protecting groove (80) allows a region of the first cylinder (51) located outside the protecting groove (80) (a side further from the center of the first cylinder (51) than the protecting groove (80) is, i.e., an area of a surface to which a compression force produced by bolting is applied) to have a larger area than in the case where the groove width (W) of the protecting groove (80) is longer than the groove depth (D) of the protecting groove (80). This can reduce the amount of deformation in the bolted position. Therefore, the amount of the deformation in the center portion of the first cylinder head member (61) can be reduced, too.

A second aspect of the present disclosure is according to the first aspect of the present disclosure. In the compressor of the second aspect, another protecting groove (80) is also provided to one axial end face of the first cylinder (51).

According to the second aspect, the protecting groove (80) is provided to both the end face of the first cylinder head member (61) contacting the first cylinder (51), and the axial one end face of the first cylinder (51). This configuration can improve a deformation absorption effect (an effect of absorbing the deformation in the bolted position) of the protecting groove (80) more significantly than in a case where the protecting groove (80) is provided to only the end face of the first cylinder head member (61) contacting the first cylinder (51), or the one axial end face of the first cylinder (51). As a result, the deformation in the bolted position is much less likely to be transmitted toward the inner periphery (to the region inside of the protecting groove (80)).

A third aspect of the present disclosure is according to the second aspect of the present disclosure. In the compressor of the third aspect, the protecting groove (80) provided to the end face of the first cylinder head member (61) contacting the first cylinder (51) is formed so as to overlap with the protecting groove (80) provided to the one axial end face of the first cylinder (51) when viewed in plan.

According to the third aspect of the present disclosure, the protecting groove (80) provided to the end face of the first cylinder head member (61) contacting the first cylinder (51) (hereinafter referred to as a first protecting groove (81)) is formed so as to overlap with the protecting groove (80) provided to the one axial end face of the first cylinder (51) (hereinafter referred to as a second protecting groove (82)) when viewed in plan. This makes it possible to substantially prevent the deformation in the bolted position from being transmitted between the first protecting groove (81) and the second protecting groove (82) toward the inner periphery (the side closer to the center of the first cylinder (51)). Thus, the deformation in the bolted position can be properly absorbed by the protecting groove (80), thereby making it possible to properly reduce the deformation in the center portion (the portion facing the first piston (52)) of the first cylinder head member (61).

A fourth aspect of the present disclosure is according to any one of the first to third aspects of the present disclosure. In the compressor of the fourth aspect, another protecting groove (80) is also provided to at least one of an end face of the second cylinder head member (62) contacting the first cylinder (51), or the other axial end face of the first cylinder (51).

According to the fourth aspect, the protecting groove (80) is provided to at least one of the end face of the second cylinder head member (62) contacting the first cylinder (51), or the other axial end face of the first cylinder (51). Thus, the deformation in the bolted position can be absorbed by the protecting groove (80), and the deformation in the bolted position is less likely to be transmitted toward the inner periphery (to the region inside of the protecting groove (80)). This can reduce the deformation in the center portion (the portion facing the first piston (52)) of the second cylinder head member (62).

A fifth aspect of the present disclosure is according to any one of the first to third aspects of the present disclosure. In the compressor of the fifth aspect, the compression mechanism (40) further includes a middle plate (60) disposed adjacent to the other axial end of the first cylinder (51), a ring-shaped second cylinder (56) disposed between the middle plate (60) and the second cylinder head member (62), and a second piston (57) rotating eccentrically in an interior of the second cylinder (56), the fastening bolt (70) fastens the first cylinder head member (61), the first cylinder (51), the middle plate (60), the second cylinder (56), and the second cylinder head member (62) together, and another protecting groove (80) is also provided to at least one of an end face of the second cylinder head member (62) contacting the second cylinder (56), or the other axial end face of the second cylinder (56).

According to the fifth aspect, the protecting groove (80) is provided to at least one of the end face of the second cylinder head member (62) contacting the second cylinder (56), or the other axial end face of the second cylinder (56). Thus, the deformation in the bolted position can be absorbed by the protecting groove (80), and the deformation in the bolted position is less likely to be transmitted toward the inner periphery (to the region inside of the protecting groove (80)). This can reduce the deformation in the center portion (the portion facing the second piston (57)) of the second cylinder head member (62).

A sixth aspect of the present disclosure is according to the fifth aspect of the present disclosure. In the compressor of the sixth aspect, another protecting groove (80) is also provided to at least the other axial end face of the first cylinder (51), or an end face of the middle plate (60) contacting the first cylinder (51), and another protecting groove (80) is also provided to at least one of one axial end face of the second cylinder (56), or an end face of the middle plate (60) contacting the second cylinder (56).

According to the sixth aspect, the protecting groove (80) is provided to at least one of the other axial end face of the first cylinder (51), or the end face of the middle plate (60) contacting the first cylinder (51). Thus, the deformation in the bolted position can be absorbed by the protecting groove (80), and the deformation in the bolted position is less likely to be transmitted toward the inner periphery (to the region inside of the protecting groove (80)). This can reduce the deformation in the center portion (the portion facing the first piston (52)) of the middle plate (60).

Also, according to the sixth aspect, the protecting groove (80) is provided to at least one of the one axial end face of the second cylinder (56), or the end face of the middle plate (60) contacting the second cylinder (56). Thus, the deformation in the bolted position can be absorbed by the protecting groove (80), and the deformation in the bolted position is less likely to be transmitted toward the inner periphery (to the region inside of the protecting groove (80)). This can reduce the deformation in the center portion (the portion facing the second piston (57)) of the middle plate (60).

A seventh aspect of the present disclosure is according to the second aspect of the present disclosure. In the compressor of the seventh aspect, the first cylinder (51) is provided with a first suction port (51*a*) radially passing through the first cylinder (51), and the protecting groove (80) provided to the one axial end face of the first cylinder (51) is formed so as not to overlap with the first suction port (51*a*) when viewed in plan.

According to the seventh aspect, the protecting groove (80) is formed in the one axial end face of the first cylinder (51) so as not to overlap with the first suction port (51*a*) of the first cylinder (51) when viewed in plan. This can avoid formation of the protecting groove (80) at the portion where the first suction port (51*a*) of the first cylinder (51) is formed (i.e., a low-rigidity portion). This can provide the first cylinder (51) with strength.

An eighth aspect of the present disclosure is according to the first aspect of the present disclosure. In the compressor of the eighth aspect, the first cylinder head member (61) is provided with a first discharge port (61*a*) axially passing through the first cylinder head member (61), and the protecting groove (80) provided to the end face of the first cylinder head member (61) contacting the first cylinder (51) is formed so as not to overlap with the first discharge port (61*a*) when viewed in plan.

According to the eighth aspect, the protecting groove (80) is formed in the end face of the first cylinder head member (61) contacting the first cylinder (51) so as not to overlap with the first discharge port (61*a*) of the first cylinder head member (61) when viewed in plan. This can avoid formation of the protecting groove (80) at the portion where the first discharge port (61*a*) of the first cylinder head member (61) is formed (i.e., a low-rigidity portion).

A ninth aspect of the present disclosure is according to any one of the first to eighth aspects of the present disclosure. In the compressor of the ninth aspect, the protecting groove (80) is gradually tapered toward a bottom such that the groove width (W) becomes gradually shorter toward the bottom.

In the ninth aspect, the protecting groove (80) can easily be formed in the components (e.g., the cylinder head member (61, 62) and the first cylinder (51)) forming the compression mechanism (40).

A tenth aspect of the present disclosure is according to any one of the first to ninth aspects of the present disclosure. In the compressor of the ninth aspect, the protecting groove (80) is formed so as to extend circumferentially, and the fastening bolt (70) is disposed on a center line between the protecting groove (80) and an outer circumference of the first cylinder (51) when viewed in plan.

As the distance between the bolted position and the protecting groove (80) decreases, a compression force acting on the vicinity of the protecting groove (80) (the deformation force in the same direction as the direction of compressing and deforming the first cylinder (51)) tends to increase. As the distance between the bolted position and the protecting groove (80) increases (i.e., as the bolted position becomes closer to the outer periphery of the first cylinder (51)), the difference between the amount of compression and deformation in the portion near the outer periphery of the first cylinder (51) and the amount of compression and deformation in the portion of the first cylinder (51) near the narrow groove (80) tends to increase, and a separating force acting on the portion near the protecting groove (80) (a force trying to cause axially outward deformation) also tends to increase.

According to the tenth aspect, the fastening bolt (70) is disposed on the center line between the protecting groove (80) and the outer circumference of the first cylinder (51) when viewed in plan. This can properly reduce both the compression force and the separating force that act on the portion near the protecting groove (80), thereby properly reducing the deformation in the portion near the protecting groove (80). This can properly reduce the deformation in the center portion of the cylinder head member (61, 62).

An eleventh aspect of the present disclosure is according to the first aspect of the present disclosure. In the compressor of the eleventh aspect, the first cylinder head member (61) is provided with a first discharge port (61*a*) axially passing through the first cylinder head member (61), and the protecting groove (80) is provided to only a high-pressure region (RH) ranging from a position of the first discharge port (61*a*) to a position on an opposite side of a center of the first cylinder (51) from the first discharge port (61*a*) along a direction opposite a rotation direction of the first piston (52).

According to the eleventh aspect, the protecting groove (80) is formed in the high pressure region (RH), and thus, variation in the gap length between the first cylinder head member (61) and the first piston (52) due to bolting can be reduced in the high pressure region (RH). Also, no protecting groove (80) is formed in a low pressure region (i.e., a region ranging from the position of the first discharge port (61*a*) to the position on the opposite side of the center of the first cylinder (51) from the first discharge port (61*a*) along the rotation direction of the first piston (52)). Thus, this can reduce an average increase in the gap length between the first cylinder head member (61) and the first piston (52) caused by the formation of the protecting groove (80) in the low pressure region. In the high pressure region (RH), contact between the first cylinder head member (61) and the first piston (52) is more likely to occur than in the low pressure region. In the low pressure region, lubricant (refrigerating machine oil) is more likely to be leaked from the interior of the first piston (52) toward the interior of the first cylinder (51) through the gap between the first cylinder head member (61) and the first piston (52) than in the high pressure region (RH).

Advantages of the Invention

The first aspect of the present disclosure allows for reducing the deformation in the center portion (the portion facing the first piston (52)) of the first cylinder head member (61), thereby making it possible to reduce variation in the gap length between the first cylinder head member (61) and the first piston (52) due to bolting.

The first aspect of the present disclosure also allows for reducing the amount of deformation in the center portion of the first cylinder head member (61), thereby making it possible to reduce variation in the gap length between the first cylinder head member (61) and the first piston (52).

According to the second aspect of the present disclosure, the deformation in the bolted position can be much less likely to be transmitted toward the inner periphery (to the region inside of the protecting groove (80)), compared to the case where the protecting groove (80) is provided to only the end face of the first cylinder head member (61) contacting the first cylinder (51), or the other axial end face of the first cylinder (51). Thus, the variation in the gap length between the first cylinder head member (61) and the first piston (52) can be further reduced.

The third aspect of the present disclosure allows for properly reducing the deformation in the center portion (the portion facing the first piston (52)) of the first cylinder head member (61), thereby making it possible to properly reduce the variation in the gap length between the first cylinder head member (61) and the first piston (52) due to bolting.

The fourth aspect of the present disclosure allows for reducing the deformation in the center portion (the portion facing the first piston (52)) of the second cylinder head member (62), thereby making it possible to reduce the variation in the gap length between the second cylinder head member (62) and the first piston (52) due to bolting.

The fifth aspect of the present disclosure allows for reducing the deformation in the center portion (the portion facing the second piston (57)) of the second cylinder head member (62), thereby making it possible to reduce the variation in the gap length between the second cylinder head member (62) and the second piston (57) due to bolting.

The sixth aspect of the present disclosure allows for reducing the deformation in the center portion (the portion facing the first piston (52)) of the middle plate (60), thereby making it possible to reduce the variation in the gap length between the middle plate (60) and the first piston (52) due to bolting.

Also, the sixth aspect of the present disclosure allows for reducing the deformation in the center portion (the portion facing the second piston (57)) of the middle plate (60), thereby making it possible to reduce the variation in the gap length between the middle plate (60) and the second piston (57) due to bolting.

The seventh aspect of the present disclosure can avoid formation of the protecting groove (80) at a portion where the first suction port (51*a*) of the first cylinder (51) is formed (i.e., a low-rigidity portion), thereby making it possible to provide the first cylinder (51) with a strength.

The eighth aspect of the present disclosure can avoid formation of the protecting groove (80) at a portion where the first discharge port (61*a*) of the first cylinder head member (61) is formed (i.e., a low-rigidity portion), thereby making it possible to provide the first cylinder head member (61) with a strength.

The ninth aspect of the present disclosure allows for easily forming the protecting groove (80) in the components (e.g., the cylinder head member (61, 62) and the first cylinder (51)) forming the compression mechanism (40). As a result, the components of the compression mechanism (40) can be easily manufactured.

The tenth aspect of the present disclosure allows for properly reducing the deformation amount in the center of the cylinder head member (61, 62), thereby making it possible to properly reduce the variation amount in the gap length between the cylinder head member (61, 62) and the first piston (52).

According to the eleventh aspect of the present disclosure, providing the protecting groove (80) to only the high pressure region (RH) can reduce the variation in the gap length between the first cylinder head member (61) and the first piston (52) due to bolting in the high pressure region (RH). This can effectively reduce contact between the first cylinder head member (61) and the first piston (52) in the high pressure region (RH). Also, in the low pressure region, the average increase in the gap length between the first cylinder head member (61) and the first piston (52) caused by the formation of the protecting groove (80) can be reduced. This can effectively reduce the leakage of the lubricant (refrigerating machine oil) passing through the gap between the first cylinder head member (61) and the first piston (52) in the low pressure region.

DESCRIPTION OF EMBODIMENTS

Figure 1:
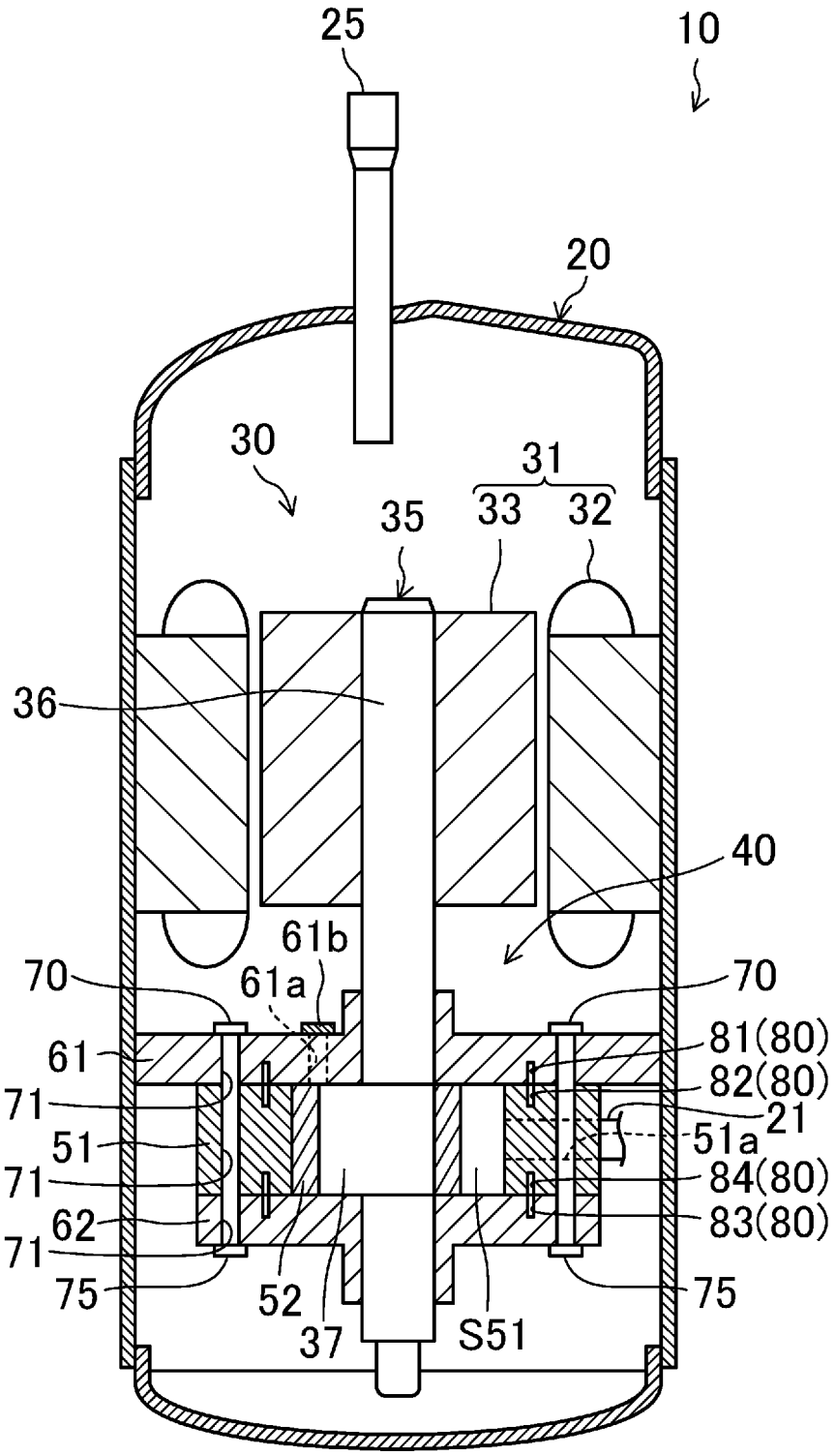
FIG. 1 is a vertical cross-sectional view illustrating an exemplary configuration for a compressor according to a first embodiment.

Embodiments will now be described in detail with reference to the drawings. Note that like reference characters denote the same or equivalent components in the drawings, and the description thereof will not be repeated.

First Embodiment

FIG. 1 illustrates an exemplary configuration for a compressor (10) according to a first embodiment. The compressor (10) is provided to, e.g., a refrigerant circuit performing a refrigeration cycle, and is configured to suck, and compress, a refrigerant (fluid) circulating in the refrigerant circuit. The compressor (10) includes a casing (20), a driving mechanism (30), and a compression mechanism (40).

[Casing]

The casing (20) is a hermetically-sealed container with a vertically oriented cylindrical shape. The casing (20) houses the driving mechanism (30) and the compression mechanism (40). In the bottom of the casing (20), lubricant (refrigerating machine oil) is stored. The body of the casing (20) is provided with a first suction pipe (21). The first suction pipe (21) passes through the body of the casing (20) to be connected to the compression mechanism (40). The upper portion of the casing (20) is provided with a discharge pipe (25). The discharge pipe (25) passes through the upper portion of the casing (20) to communicate with an interior space of the casing (20) (specifically, the upper space of the driving mechanism (30)).

[Driving Mechanism]

The driving mechanism (30) is configured to drive the compression mechanism (40). The driving mechanism (30) includes an electric motor (31) and a drive shaft (35). In this example, the electric motor (31) is disposed above the compression mechanism (40) in the casing (20). Specifically, the electric motor (31) and the compression mechanism (40) are sequentially disposed from top to bottom (from one end to the other end in an axial direction). The drive shaft (35) extends in the axial direction of the casing (20), and connects the electric motor (31) and the compression mechanism (40) together.

<Electric Motor>

The electric motor (31) includes a stator (32) and a rotor (33). The stator (32) is cylindrically-shaped, and is fixed to the body of the casing (20). The rotor (33) is cylindrically-shaped, and is disposed inside a region surrounded by the stator (32). For example, the stator (32) has a stator core formed in a cylindrical shape, and a coil wound around the stator core. The rotor (33) has a rotor core including a plurality of electromagnetic steel sheets stacked in the axial direction, and a magnet buried in the rotor core. When a current flows in the coil of the stator (32), the rotor (33) is rotated by an electromagnetic force generated in the stator (32).

<Driving Shaft>

The drive shaft (35) includes a main shaft (36) and a first eccentric portion (37). The main shaft (36) is cylindrically-shaped and extends in the axial direction (in this example, in the vertical direction) of the casing (20). The rotor (33) of the electric motor (31) is fixed to the main shaft (36). With such a configuration, the drive shaft (35) is rotated together with the rotor (33) of the electric motor (31). The first eccentric portion (37) is disposed in a portion of the main shaft (36) where the main shaft (36) passes through the compression mechanism (40). The first eccentric portion (37) is formed in a cylindrical-column shape with a diameter larger than that of the main shaft (36), and the axial center of the first eccentric portion (37) is eccentric from the axial center of the main shaft (36).

[Compression Mechanism]

The compression mechanism (40) is configured to compress and discharge a fluid (for example, a refrigerant) sucked from the first suction pipe (21). In this example, the compression mechanism (40) includes a first cylinder (51), a first piston (52), a first cylinder head member (61), a second cylinder head member (62), and a plurality of fastening bolts (70). In this compression mechanism (40), the first cylinder head member (61), the first cylinder (51), and the second cylinder head member (62) are sequentially disposed from top to bottom (from one end to the other end in the axial direction).

Figure 2:
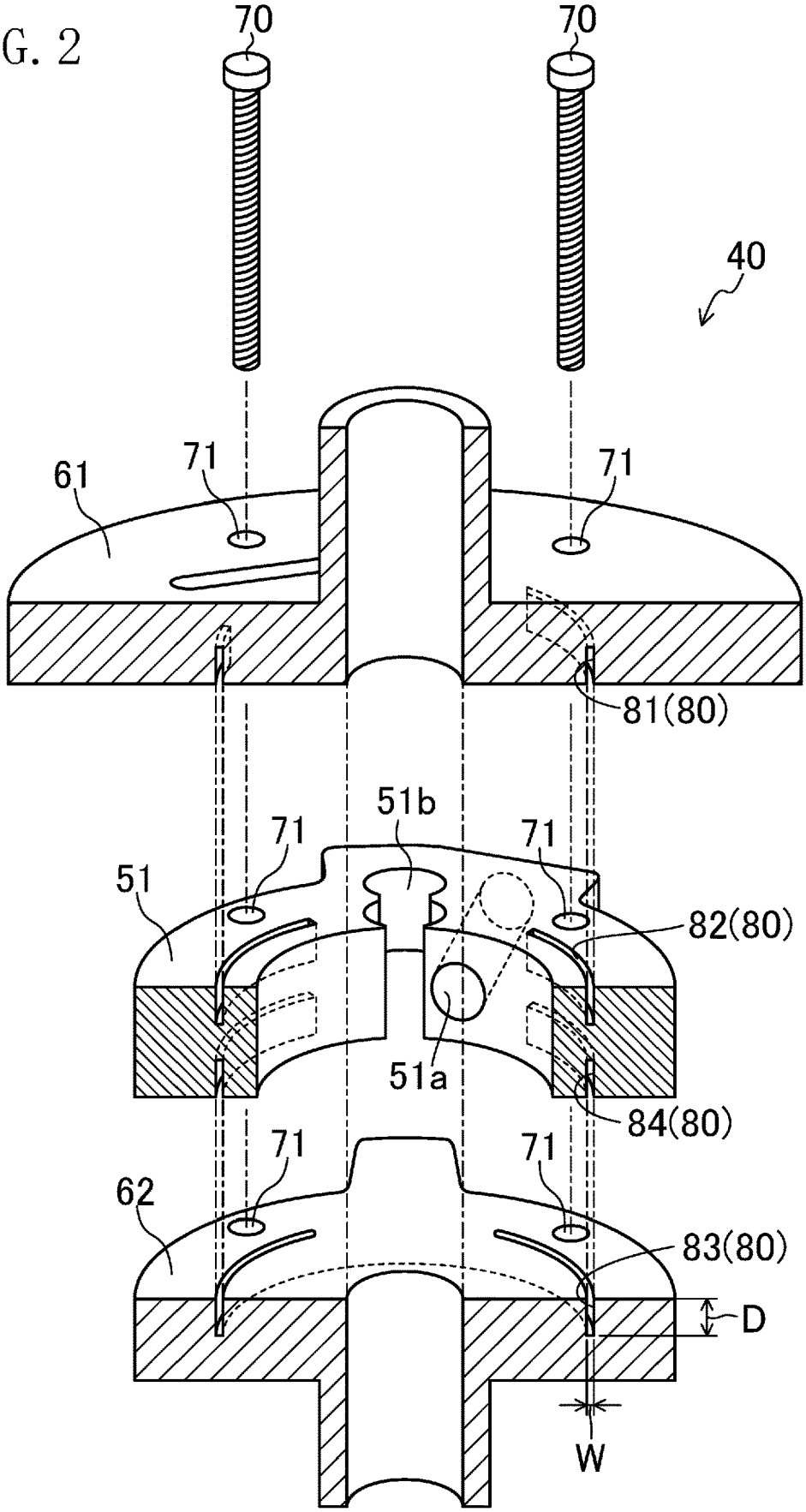
FIG. 2 is an exploded perspective view illustrating main parts of the compressor according to the first embodiment.
Figure 3:
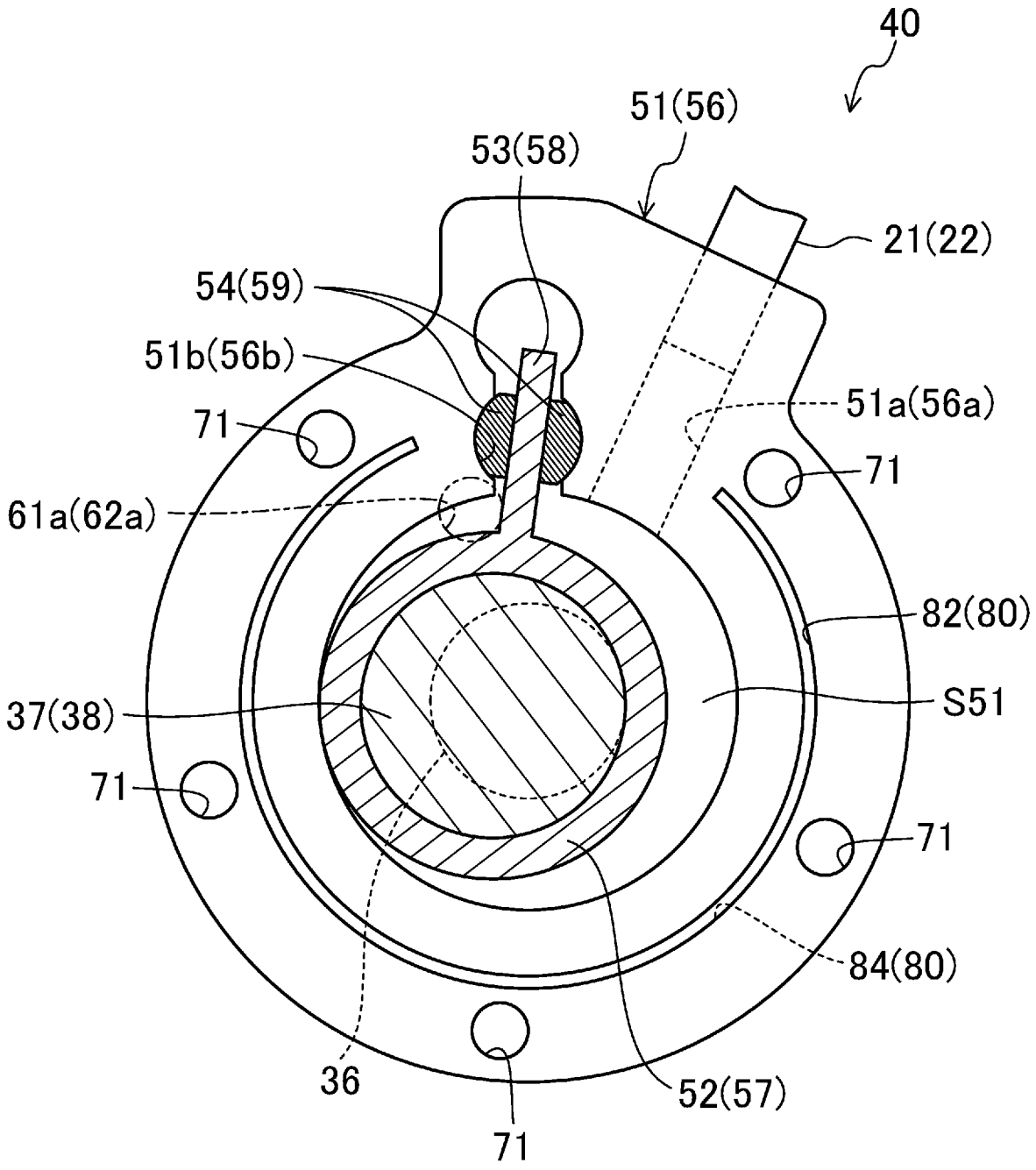
FIG. 3 is a plan view illustrating an exemplary configuration for a cylinder and a piston.
Figure 4:
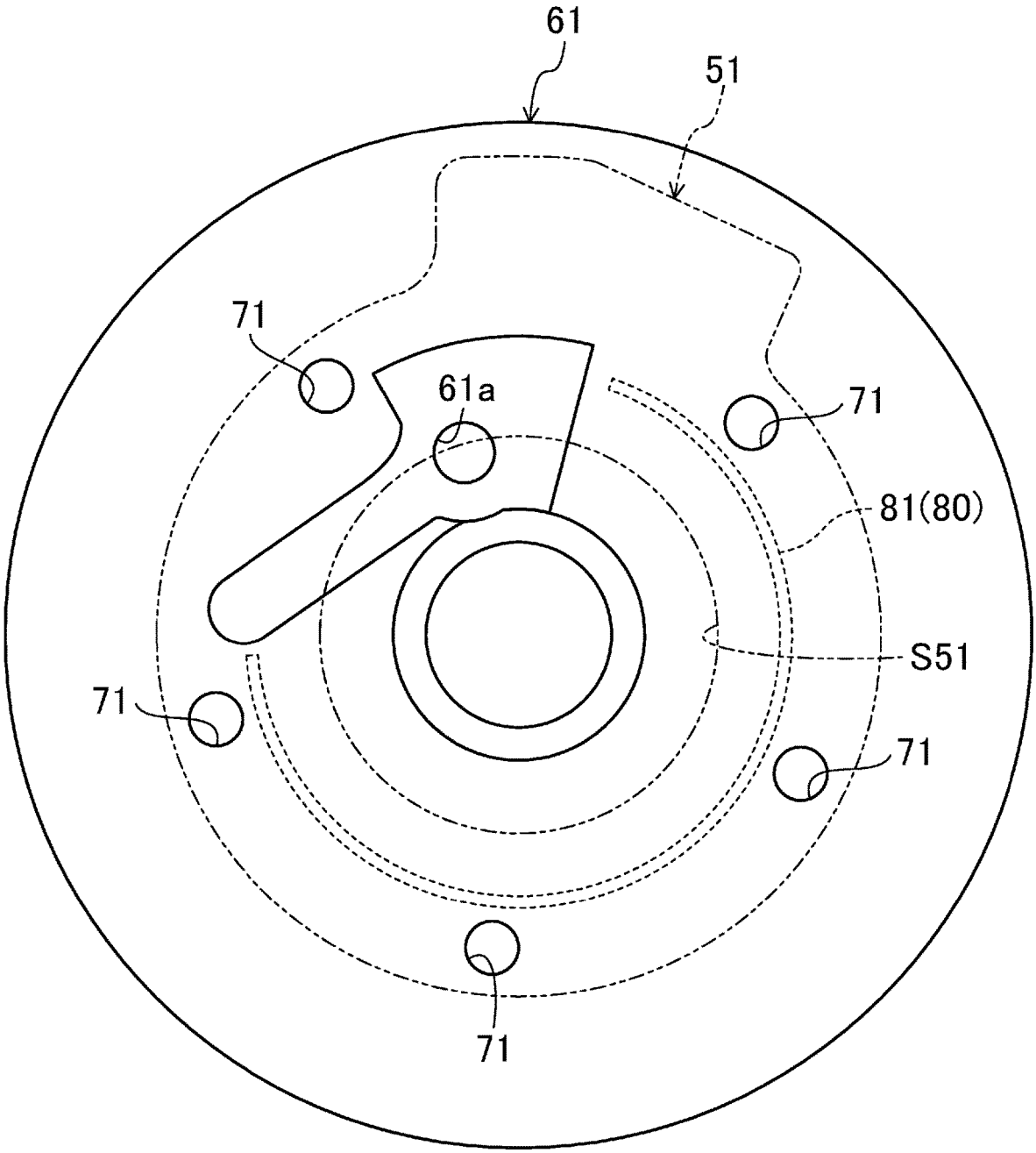
FIG. 4 is a plan view illustrating an exemplary configuration for a first cylinder head member.
Figure 5:
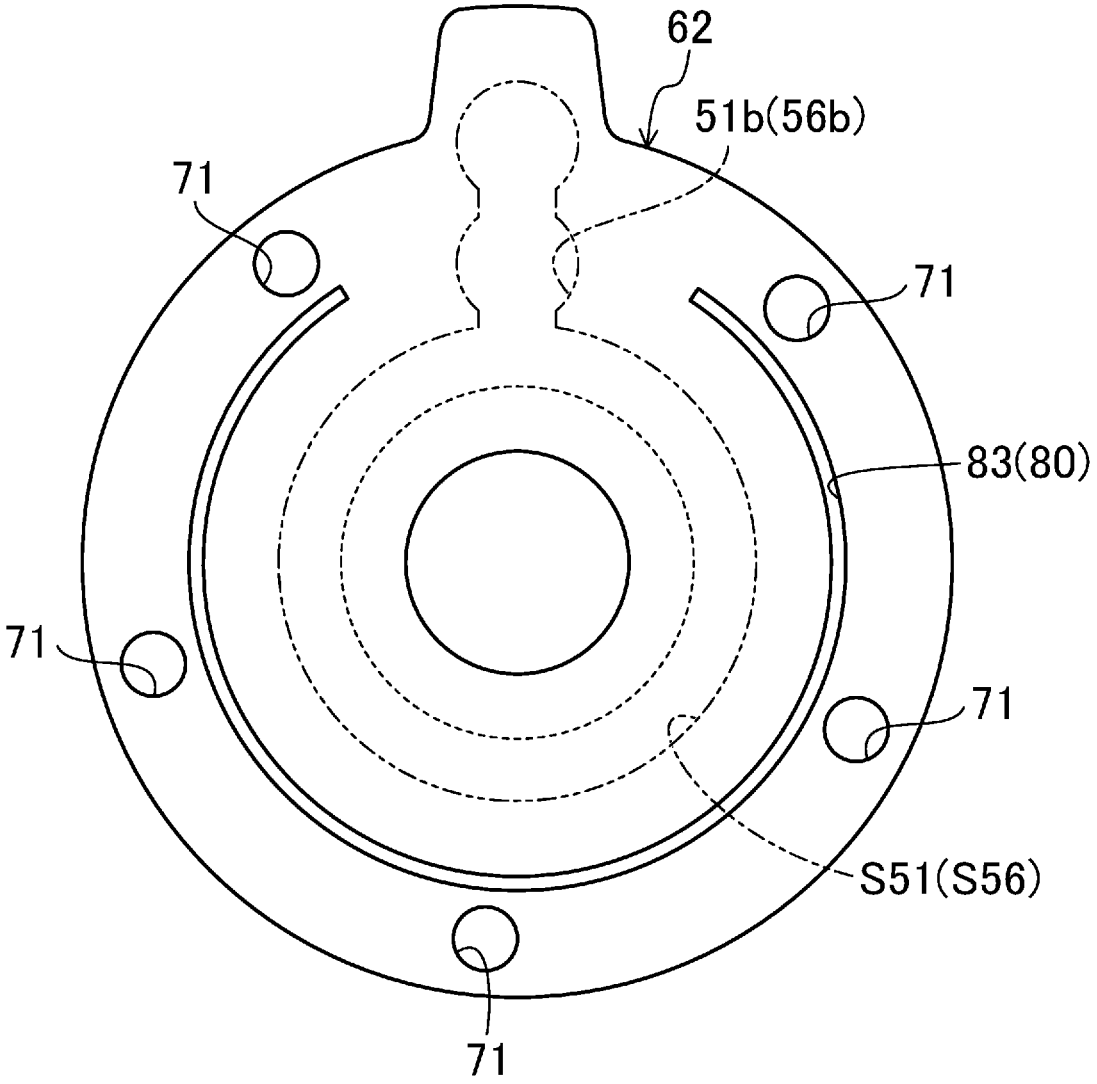
FIG. 5 is a plan view illustrating an exemplary configuration for a second cylinder head member.

Next, the components forming the compression mechanism (40) will be described with reference to FIGS. 1 to 5. FIG. 2 is an exploded perspective view illustrating the compression mechanism (40). FIG. 3 is a top view of the cylinder and the piston. FIG. 4 is a top view of the first cylinder head member (61). FIG. 5 is a top view of the second cylinder head member (62). FIG. 2 illustrates the compression mechanism (40) with its half circumference cut away.

<First Cylinder and First Piston>

In the first cylinder (51), a first cylinder chamber (S51) is formed. Specifically, the first cylinder (51) is ring-shaped, and the interior space thereof constitutes the first cylinder chamber (S51). The first cylinder (51) has flat end faces at its both axial ends. In the first cylinder chamber (S51), the first eccentric portion (37) of the drive shaft (35) is disposed. The first cylinder (51) is provided with a first suction port (51*a*). The first suction port (51*a*) radially passes through the first cylinder (51) to communicate with the first cylinder chamber (S51). The first suction pipe (21) is inserted into, and fixed to, the first suction port (51*a*).

The first piston (52) is disposed in the first cylinder chamber (S51) of the first cylinder (51), and is configured to rotate eccentrically in the interior of the first cylinder (51) (i.e., in the first cylinder chamber (S51)). Specifically, the first piston (52) is cylindrically-shaped, and the first eccentric portion (37) is slidably fitted to the inner periphery of the first piston (52). With such a configuration, rotation of the drive shaft (35) allows the first piston (52) to rotate eccentrically in the first cylinder chamber (S51), and as a result, the fluid sucked into the first cylinder chamber (S51) is compressed. The first piston (52) has flat end faces at its both axial ends.

As illustrated in FIG. 3, the first piston (52) is integrally provided with a first blade (53). The first blade (53) radially extends outwardly from the outer periphery of the first piston (52) to divide the first cylinder chamber (S51) into a low pressure side and a high pressure side. Also, the first cylinder (51) is provided with a first bush groove (51*b*). The first bush groove (51*b*) is circular-shaped when viewed in plan. The first bush groove (51*b*) houses a pair of first bushes (54) therein. The pair of the first bushes (54) each have a half-moon shape when viewed in plan. The pair of the first bushes (54) are housed in the first bush groove (51*b*), with the first blade (53) sandwiched therebetween.

<First Cylinder Head Member>

The first cylinder head member (61) is disposed above the first cylinder (51) (at one axial end) to cover the upper end of the first cylinder (51). The first cylinder head member (61) is provided with a first discharge port (61*a*). The first discharge port (61*a*) axially passes through the first cylinder head member (61) to communicate with the first cylinder chamber (S51) of the first cylinder (51). The first cylinder head member (61) is provided with a first discharge valve (61*b*) opening/closing an outlet of the first discharge port (61*a*). The first discharge valve (61*b*) is comprised of, e.g., a reed valve.

In this example, the first cylinder head member (61) has a disk-shaped head body and a boss. The cylinder head body includes, at its center, a bearing hole into which the drive shaft (35) is inserted. The boss protrudes upwardly (toward one axial end) from the inner periphery of the head body so as to surround the bearing hole. The head body of the first cylinder head member (61) has flat end faces at its both axial ends.

<Second Cylinder Head Member>

The second cylinder head member (62) is disposed under the first cylinder (51) (at the other axial end) to cover the lower end of the first cylinder (51). In this example, the second cylinder head member (62) has a disk-shaped head body and a boss. The head body includes, at its center, a bearing hole with its center into which the drive shaft (35) is inserted. The boss protrudes downwardly (toward the other axial end) from the inner periphery of the head body so as to surround the bearing hole. The head body of the second cylinder head member (62) has flat end faces at its both axial ends.

<Fastening Bolt>

The plurality of fastening bolts (70) fasten the first cylinder head member (61), the first cylinder (51), and the second cylinder head member (62) together. In this example, the plurality of fastening bolts (70) are circumferentially arranged. Specifically, the plurality of fastening bolts (five in this example) (70) are circumferentially arranged at predetermined intervals (72° intervals in this example). The plurality of the fastening bolts (70) sequentially pass through a insertion hole (71) provided to the first cylinder head member (61), another insertion hole (71) provided to the outer periphery of the first cylinder (51), and yet another insertion hole (71) provided to the second cylinder head member (62), and the tips of the fastening bolts (70) are fastened to fastening nuts (75).

<Fixing Compression Mechanism>

In this example, the first cylinder head member (61) is fixed to the body of the casing (20) by, e.g., welding. The first cylinder (51) and the second cylinder head member (62) are disposed to be spaced apart from the body of the casing (20).

[Operation of Compressor]

Next, operation of the compressor (10) illustrated in FIG. 1 will be described. A low-pressure fluid (for example, a refrigerant evaporated in an evaporator in a refrigerant circuit) flows into the first suction pipe (21). The low-pressure fluid that has flowed in the first suction pipe (21) passes through the first suction port (51*a*) of the first cylinder (51), and is sucked into the first cylinder chamber (S51) to be compressed. The fluid that has been compressed in the first cylinder chamber (S51) passes through the first discharge port (61*a*), and flows into a space above the first cylinder head member (61) (i.e., a space between the electric motor (31) and the first cylinder head member (61)). The high-pressure fluid that has flowed in the space above the first cylinder head member (61) passes through fluid passages (for example, a gap between the stator (32) and the rotor (33), and a core cut provided to the stator (32) (not illustrated)) provided to the electric motor (31), and flows into the space above the electric motor (31) (i.e., a space between the electric motor (31) and the upper portion of the casing (20)). The high-pressure fluid that has flowed in the space above the electric motor (31) passes through the discharge pipe (25), and is discharged out of the casing (20).

[Narrow Grooves (Protecting Grooves)]

As illustrated in FIG. 2, in this compression mechanism (40), the first cylinder head member (61), the first cylinder (51), and the second cylinder head member (62) are each provided with a narrow groove (80) (an example of a protecting groove (80)). Specifically, the narrow groove (80) is provided to both the lower end face (the other axial end face, i.e., the end face in contact with the first cylinder (51)) of the first cylinder head member (61), and the upper end face (the one axial end face, i.e., the end face in contact with the first cylinder head member (61)) of the first cylinder (51) facing the lower end face of the first cylinder head member (61). The narrow groove (80) is also provided to both the upper end face (the one axial end face, i.e., the end face in contact with the first cylinder (51)) of the second cylinder head member (62), and the lower end face (the other axial end face, i.e., the end face in contact with the second cylinder head member (62)) of the first cylinder (51) facing the upper end face of the second cylinder head member (62).

Each narrow groove (80) is formed to be closer to the inner periphery of the first cylinder (51) (a side closer to the center of the first cylinder (51)) than the fastening bolt (70) is. In this example, the narrow groove (80) extends circumferentially inside with respect to the plurality of fastening bolts (70). Specifically, the narrow groove (80) is arc-shaped when viewed in plan, and the diameter of this arced portion is smaller than that of an imaginary circle along the arrangement direction of the plurality of the fastening bolts (70) (the imaginary circle formed by connecting the plurality of fastening bolts (70) together). The narrow groove (80) has a groove width (W) shorter than its groove depth (D). In this example, the narrow groove (80) is formed such that the plurality of fastening bolts (70) are disposed on the center line between the narrow groove (80) and the outer circumference of the first cylinder (51) when viewed in plan.

In this example, the lower end face of the first cylinder head member (61) is provided with a first narrow groove (81), and the upper end face of the first cylinder (51) is provided with a second narrow groove (82). The upper end face of the second cylinder head member (62) is provided with a third narrow groove (83), and the lower end face of the first cylinder (51) is provided with a fourth narrow groove (84).

<First and Second Narrow Grooves>

As illustrated in FIG. 4, the first narrow groove (81) provided to the lower end face of the first cylinder head member (61) is formed so as not to overlap with the first discharge port (61*a*) of the first cylinder head member (61) when viewed in plan. Specifically, the first narrow groove (81) is C-shaped, i.e., arc-shaped when viewed in plan.

As illustrated in FIG. 3, the second narrow groove (82) provided to the upper end face of the first cylinder (51) is formed so as not to overlap with the first suction port (51*a*) and the first bush groove (51*b*) of the first cylinder (51) when viewed in plan. Specifically, the second narrow groove (82) is C-shaped, i.e., arc-shaped when viewed in plan.

As illustrated in FIG. 2, the first and second narrow grooves (81, 82) are formed so as to overlap with each other when viewed in plan. That is to say, the first and second narrow grooves (81, 82) face each other in the axial direction. Specifically, the radius of the arc-shaped portion of the first narrow groove (81) is substantially the same as that of the arc-shaped portion of the second narrow groove (82).

<Third and Fourth Narrow Grooves>

As illustrated in FIG. 5, the third narrow groove (83) provided to the upper end face of the second cylinder head member (62) is formed so as not to overlap with the first bush groove (51*b*) of the first cylinder (51) when viewed in plan. Specifically, the third narrow groove (83) is C-shaped, i.e., arc-shaped when viewed in plan.

As illustrated in FIG. 3, the fourth narrow groove (84) provided to the lower end face of the first cylinder (51) is formed so as not to overlap with the first suction port (51*a*) and the first bush groove (51*b*) of the first cylinder (51) when viewed in plan. Specifically, the fourth narrow groove (84) is C-shaped, i.e., arc-shaped when viewed in plan.

As illustrated in FIG. 2, the third and fourth narrow grooves (83, 84) are formed so as to overlap with each other when viewed in plan. That is to say, the third and fourth narrow grooves (83, 84) face each other in the axial direction. Specifically, the radius of the arc-shaped portion of the third narrow groove (83) is substantially the same as that of the arc-shaped portion of the fourth narrow groove (84).

[Variation in Gap Length Due to Bolting]

When the first cylinder head member (61), the first cylinder (51), and the second cylinder head member (62) are bolted with the fastening bolt (70), its bolting force causes compression and deformation in a portion of the first cylinder (51) around the bolted position. The compression and deformation in the first cylinder (51) causes deformation in the first cylinder head member (61) such that a portion of the outer periphery (facing the first cylinder (51)) of the first cylinder head member (61) around the bolted position is raised in the same direction as the direction in which the first cylinder (51) is compressed and deformed. If this deformation in the bolted position is transmitted to the inner periphery (a side closer to the center of the first cylinder (51)), the central portion (the portion facing the first piston (52)) of the first cylinder head member (61) may be axially deformed. As a result, a gap length between the first cylinder head member (61) and the first piston (52) may be varied. Likewise, the bolting may vary a gap length between the second cylinder head member (62) and the first piston (52).

Figure 6:
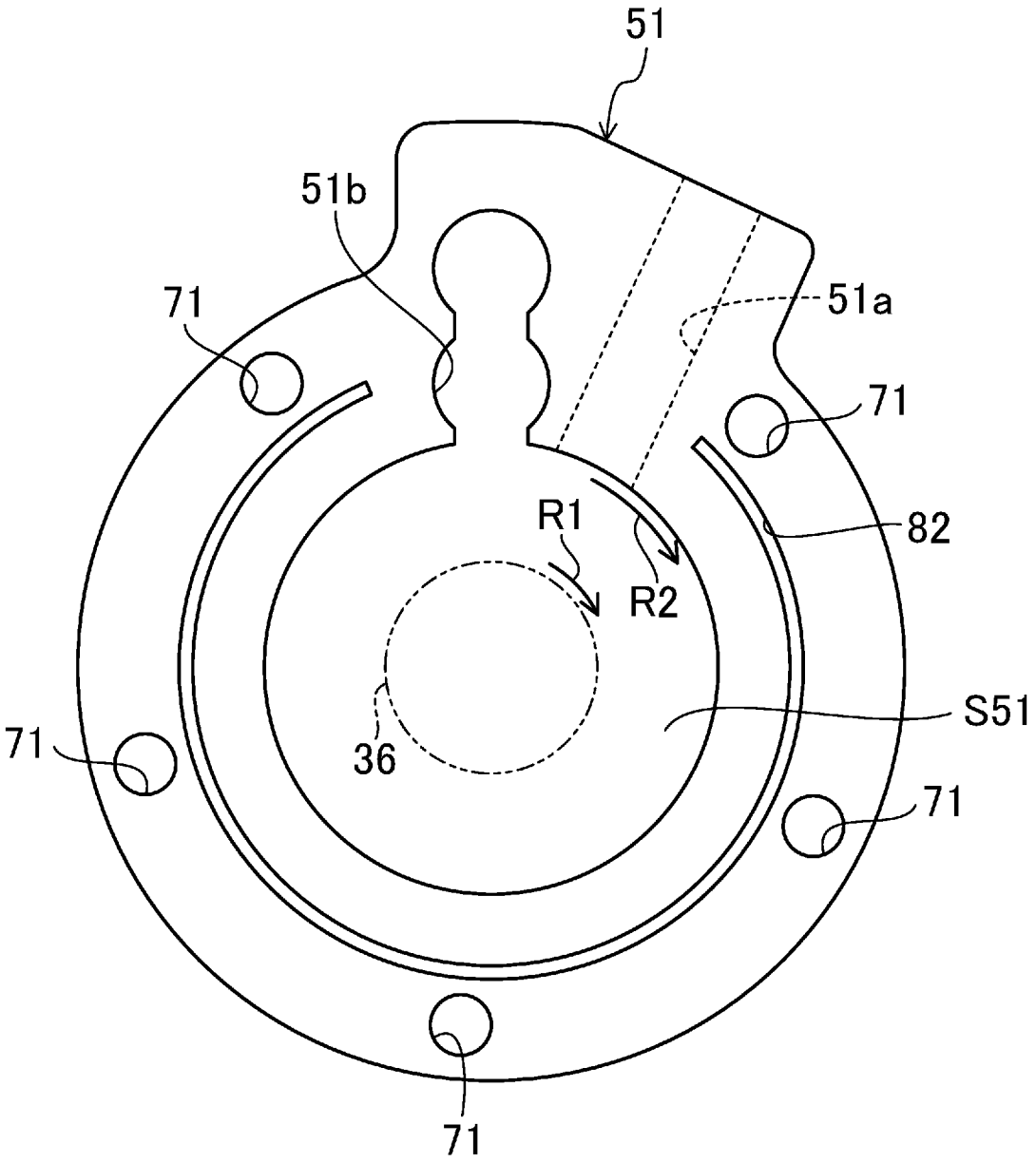
FIG. 6 is a plan view illustrating a gap length in a compression mechanism.

Here, the variation in the gap length between the first piston (52) and the first or second cylinder head member (61, 62) will be described in detail using compression mechanisms (40) as comparative examples (i.e., the compression mechanisms (40) provided with no narrow groove (80)). In the following description, the first and second cylinder head members (61, 62) are collectively referred to as "a cylinder head member (61, 62)." A gap length between the cylinder head member (61, 62) and the first piston (52) in a portion of the first cylinder chamber (S51) along the outer circumference of the main shaft (36) (a portion around and along the arrow (R1) in FIG. 6) when viewed in plan is referred to as "a gap length near the center of the cylinder." A gap length between the cylinder head member (61, 62) and the first piston (52) in another portion of the first cylinder chamber (S51) along the inner circumference of the first cylinder (51) (a portion around and along the arrow (R2) of FIG. 6) when viewed in plan is referred to as "a gap length near the cylinder inner periphery." A gap length (the gap length between the cylinder head member (61, 62) and the first piston (52)) prior to the deformation of the cylinder head member (61, 62) and the first cylinder (51) due to bolting is referred to as "a standard gap length."

<Compression Mechanism According to First Comparative Example>

First, a compression mechanism (40) according to a first comparative example (in the following description, referred to as "a compression mechanism (91)") will be described with reference to FIGS. 7 and 8. In the compression mechanism (91), no narrow groove (80) is provided to the first cylinder head member (61), the first cylinder (51), and the second cylinder head member (62). The compression mechanism (91) has a bolting position (a position into which the fastening bolt (70) is inserted) in the inner periphery of the first cylinder (51).

Figure 7:
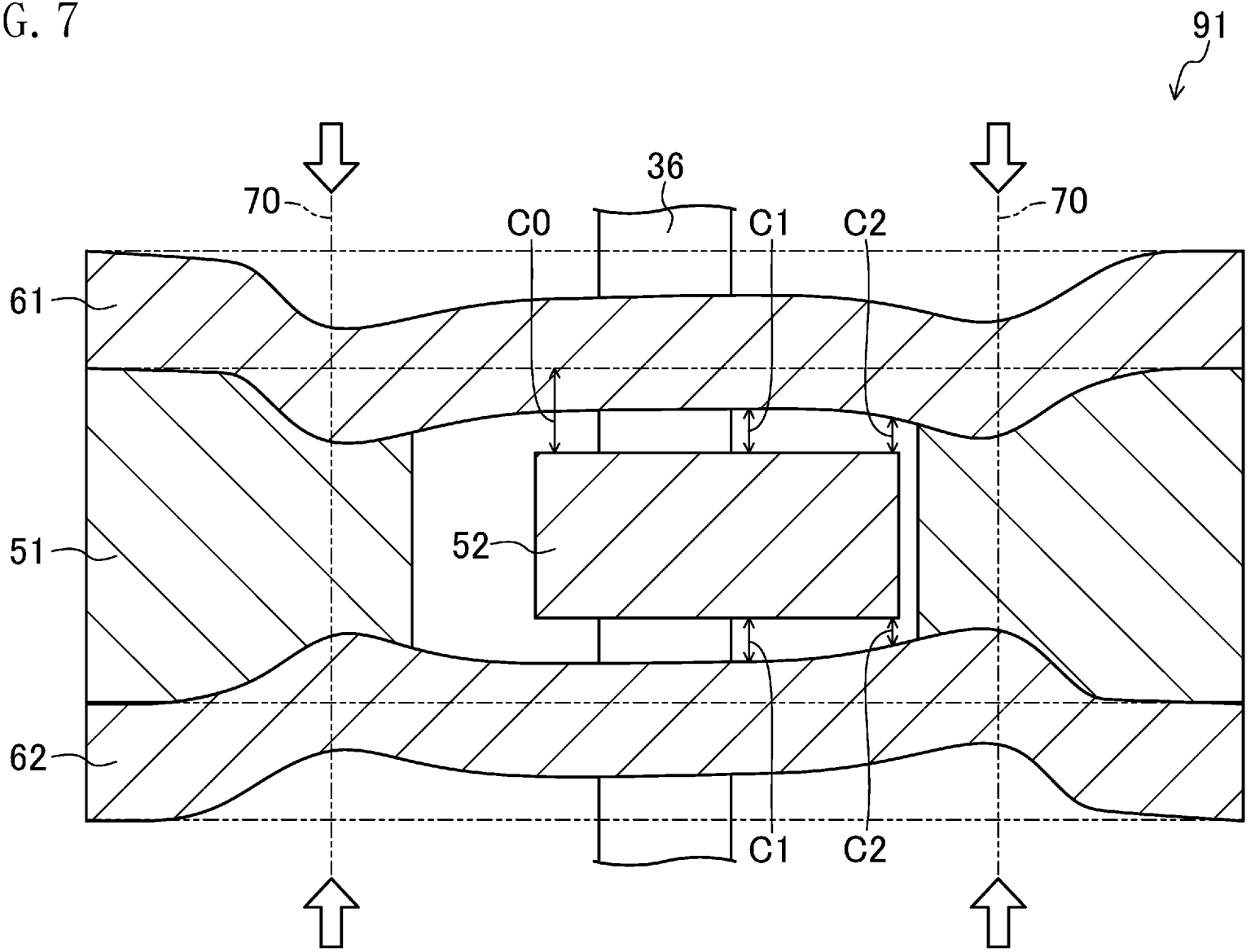
FIG. 7 is a schematic view illustrating deformation of members of a compression mechanism according to a first comparative example.
Figure 8:
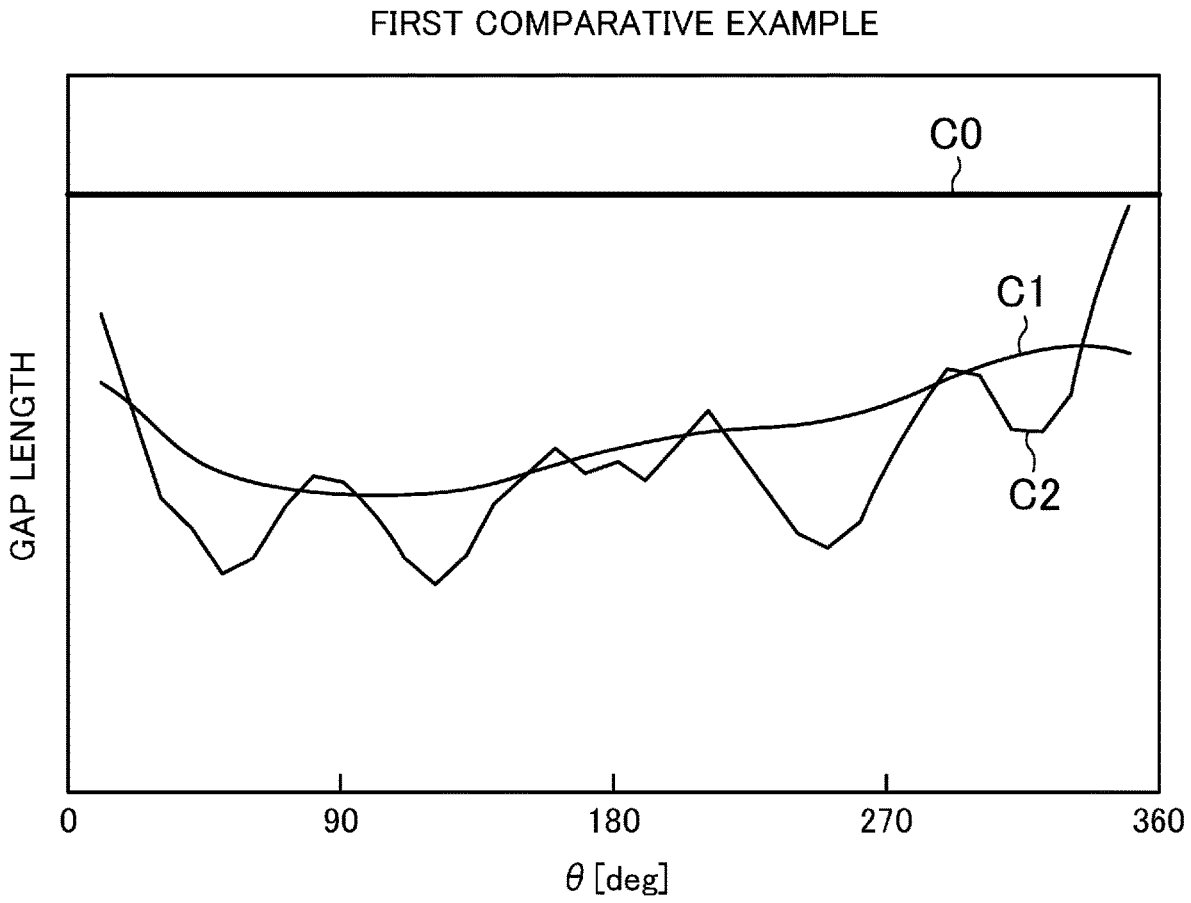
FIG. 8 is a graph showing variation in a gap length in the compression mechanism according to the first comparative example.

As illustrated in FIG. 7, in the compression mechanism (91), the deformation in the bolted position is transmitted toward the inner periphery (a side closer to the center of the first cylinder (51)), and the inner periphery of the first cylinder (51) and a portion of the cylinder head member (61, 62) around its center portion (a portion facing the inner periphery of the first cylinder (51)) are deformed in the same direction as the compression direction. Then, this deformation is transmitted toward the inner periphery, and the center portion (the portion facing the first piston (52)) of the cylinder head member (61, 62) is deformed in the same direction as the compression direction (i.e., a direction toward the first piston (52)). Therefore, the gap length between the cylinder head member (61, 62) and the first piston (52) becomes shorter as a whole. Thus, as shown in FIG. 8, the gap length (C1) near the center of the cylinder and the gap length (C2) near the cylinder inner periphery are shorter than the standard gap length (C0).

Also, the bolted position is closer to the inner periphery of the first cylinder (51). Thus, in the portion near the inner periphery of the first cylinder (51), the axial end face (the end face facing the first cylinder (51)) of the cylinder head member (61, 62) is remarkably uneven. As a result, as shown in FIG. 8, the gap length (C2) near the cylinder inner periphery is significantly varied in the circumferential direction. That is to say, the gap length (C2) in the raised portion of the axial end face of the cylinder head member (61, 62) is significantly shorter than the gap length (C2) in the recessed portion thereof.

In this way, if the gap length between the cylinder head member (61, 62) and the first piston (52) becomes too short due to the bolting, the cylinder head member (61, 62) and the first piston (52) may be come into contact with each other.

<Compression Mechanism According to Second Comparative Example>

Next, a compression mechanism (40) according to a second comparative example (in the following description, referred to as "a compression mechanism (92)") with reference to FIGS. 9 and 10. In the compression mechanism (92), no narrow groove (80) is provided to the first cylinder head member (61), the first cylinder (51), and the second cylinder head member (62). The compression mechanism (92) has a bolting position (a position into which the fastening bolt (70) is inserted) in the outer periphery of the first cylinder (51).

Figure 9:
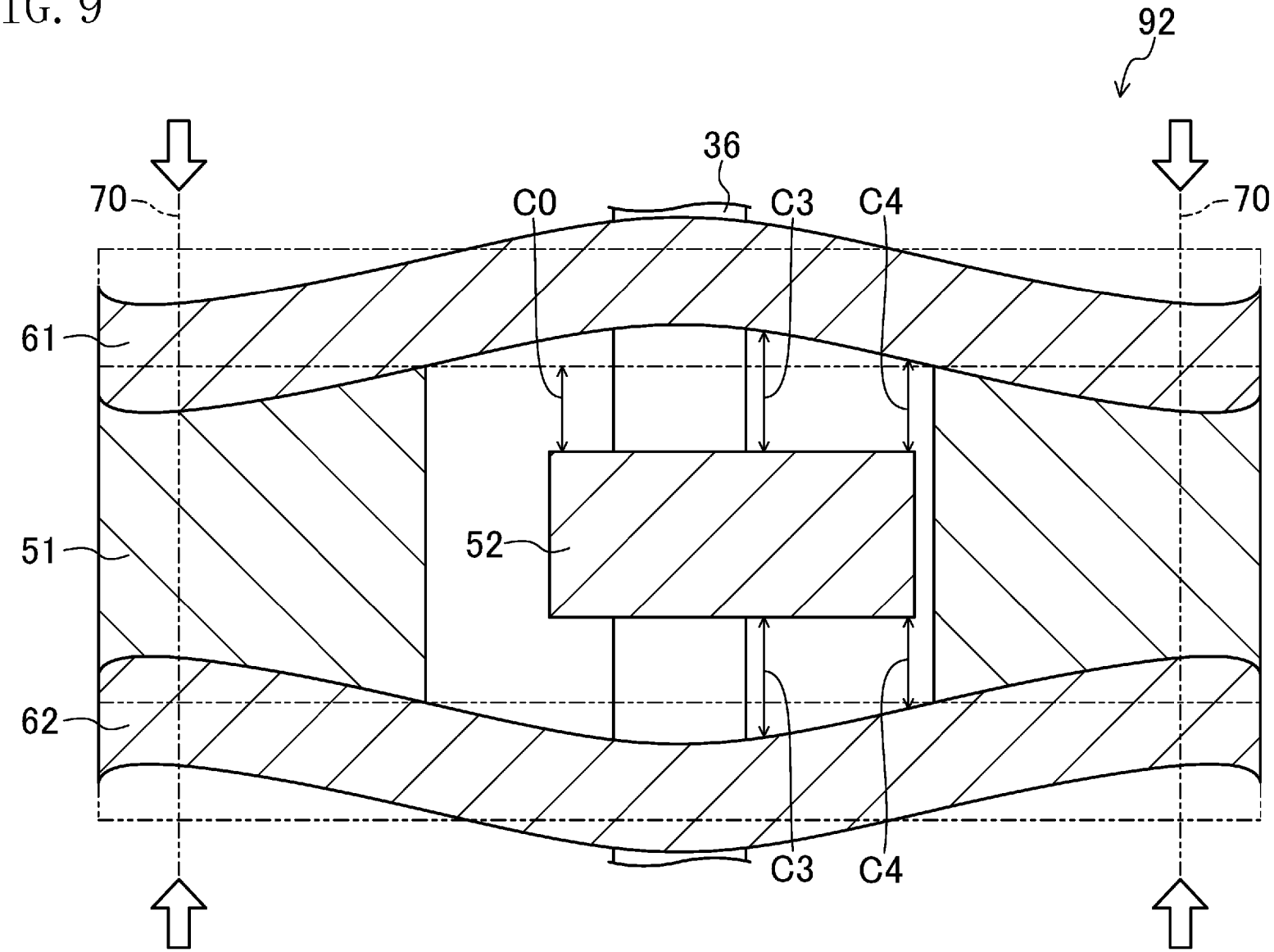
FIG. 9 is a schematic view illustrating deformation of members of a compression mechanism according to a second comparative example.

As illustrated in FIG. 9, in the compression mechanism (92), the bolted position is further from the inner periphery of the first cylinder (51), and thus, the uneven deformation in the portion of the cylinder head member (61, 62) near the inner periphery of the first cylinder (51) can be reduced. This allows for significantly reducing variation in the gap length (C4) near the cylinder inner periphery, as shown in FIG. 10. However, the axial end face of the first cylinder (51) is compressed and deformed so as to be axially outwardly inclined from the bolted position toward the inner periphery (the side closer to the center of the first cylinder (51)). Therefore, the outer peripheral portion (the portion facing the first cylinder (51)) of the cylinder head member (61, 62) is axially outwardly inclined from the bolted position toward the inner periphery, and this deformation of the outer peripheral portion of the cylinder head member (61, 62) is transmitted toward the inner periphery to outwardly bend the center portion (the portion facing the first piston (52)) of the cylinder head member (61, 62) in the axial direction (in the direction away from the first piston (52)). As a result, the gap length between the cylinder head member (61, 62) and the first piston (52) becomes longer in the portion near the center of the first cylinder (51), and as illustrated in FIG. 10, the gap length (C3) near the center of the cylinder is shorter than the standard gap length (C0).

In this way, if the gap length between the cylinder head member (61, 62) and the first piston (52) becomes too long due to the bolting, the flow rate of a fluid (a target fluid to be compressed by the compression mechanism (92)) leaked from the gap between the cylinder head member (61, 62) and the first piston (52) may be increased, resulting in deterioration of compression efficiency in the compression mechanism (92).

<Compression Mechanism According to Embodiment>

Figure 11:
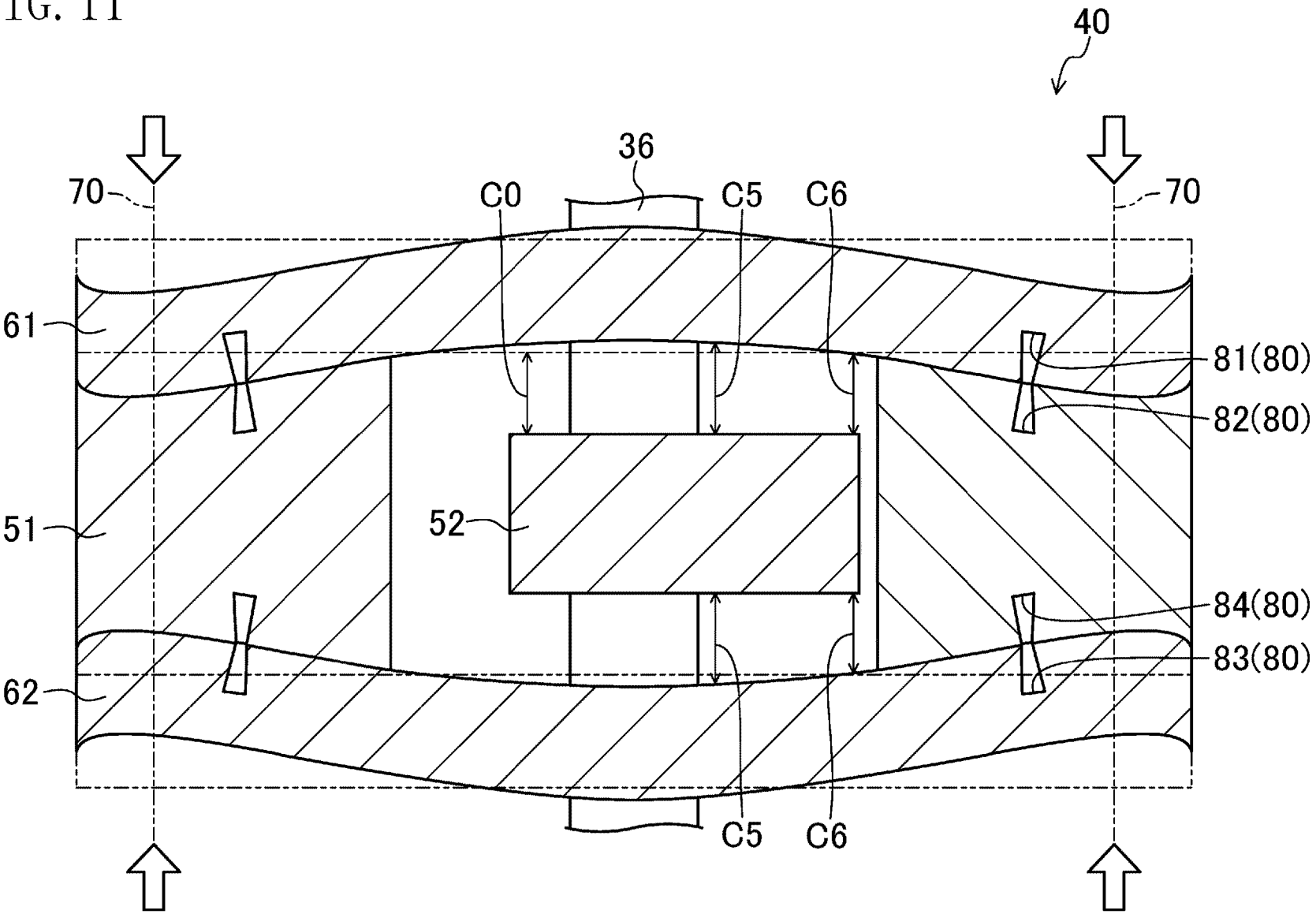
FIG. 11 is a schematic view illustrating deformation of members of the compression mechanism according to the first embodiment.
Figure 12:
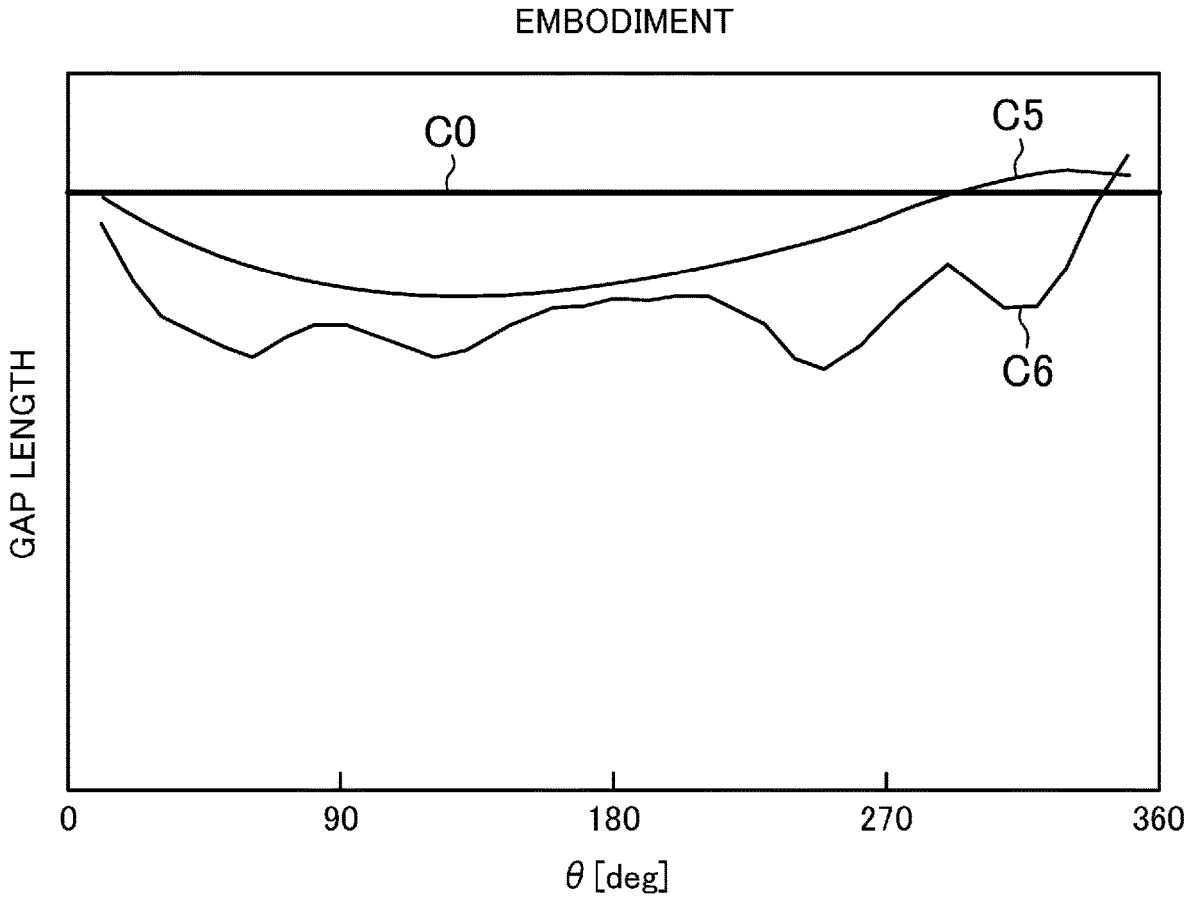
FIG. 12 is a graph showing variation in a gap length in the compression mechanism according to the first embodiment.

Next, deformation in members of the compression mechanism (40) according to the first embodiment with reference to FIGS. 11 and 12.

As illustrated in FIG. 11, in the compression mechanism (40) of the first embodiment, the lower end face of the first cylinder head member (61) is provided with the first narrow groove (81), and the upper end face of the first cylinder (51) is provided with the second narrow groove (82). The upper end face of the second cylinder head member (62) is provided with the third narrow groove (83), and the lower end face of the first cylinder (51) is provided with the fourth narrow groove (84). With this configuration, the deformation of the bolted position is absorbed in the narrow grooves (80). Thus, the deformation in the bolted position is less likely to be transmitted to a region inside of the narrow groove (80) (the side closer to the center of the first cylinder (51) than the narrow groove (80) is). This reduces the deformation in the center portion (the portion facing the first piston (52)) of the cylinder head member (61, 62), and the variation in the gap length between the cylinder head member (61, 62) and the first piston (52). Therefore, as illustrated in FIG. 12, variation in the gap length (C5) near the center of the cylinder and variation in the gap length (C6) near the cylinder inner periphery are smaller than those in the first comparative example (FIG. 8) and the second comparative example (FIG. 10).

[Compression Mechanism According to Modifications]

In the embodiment described above, the narrow groove (80) is provided to both the lower end face (the other axial end face) of the first cylinder head member (61), and the upper end face (the one axial end face) of the first cylinder (51). Alternatively, the narrow groove (80) may be provided to only the lower end face of the first cylinder head member (61), or the upper end face of the first cylinder (51).

Likewise, in the embodiment described above, the narrow groove (80) is also provided to both the upper end face (the axial end face) of the second cylinder head member (62), and the lower end face (the other axial end face) of the first cylinder (51). Alternatively, the narrow groove (80) may be provided to only the upper end face of the second cylinder head member (62), or the lower end face of the first cylinder (51).

<Compression Mechanism According to First Modification>

Figure 10:
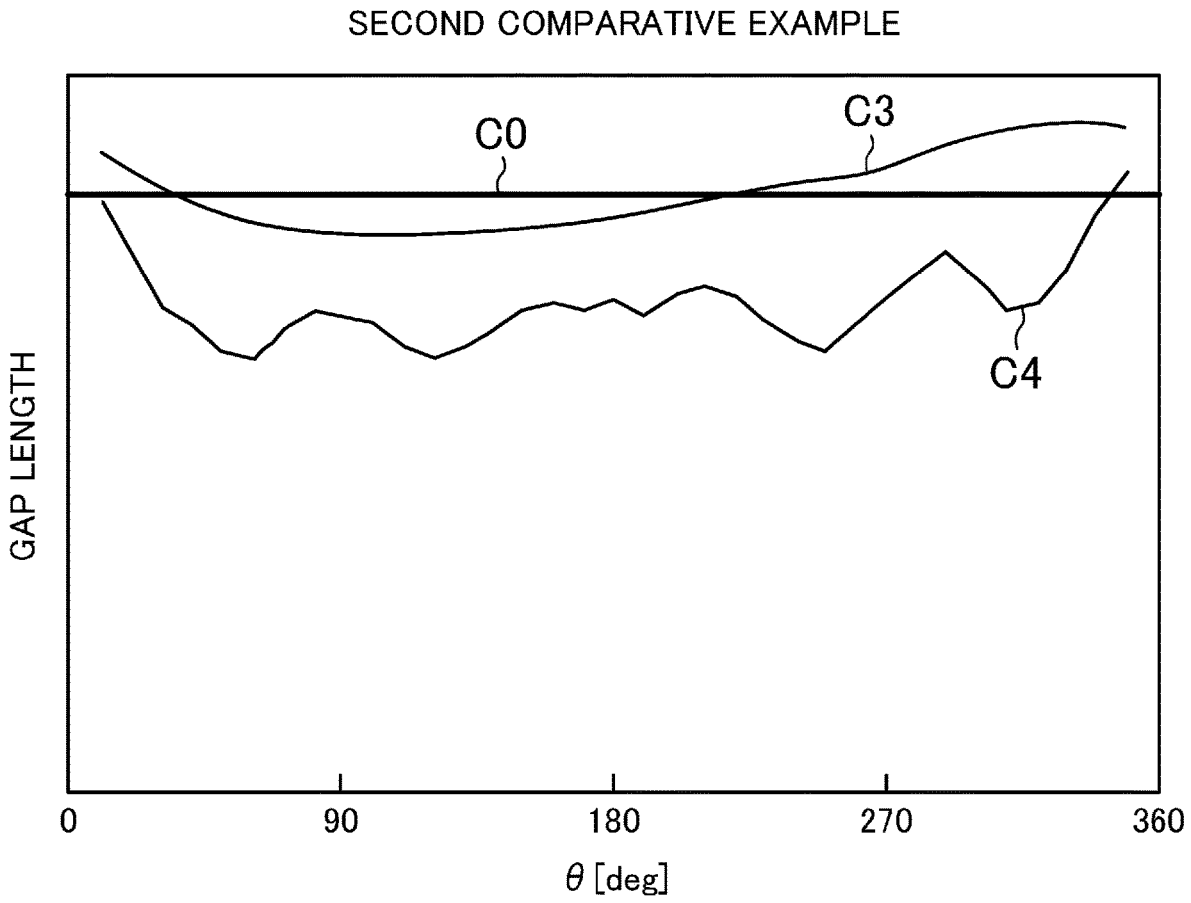
FIG. 10 is a graph showing variation in a gap length in the compression mechanism according to the second comparative example.
Figure 13:
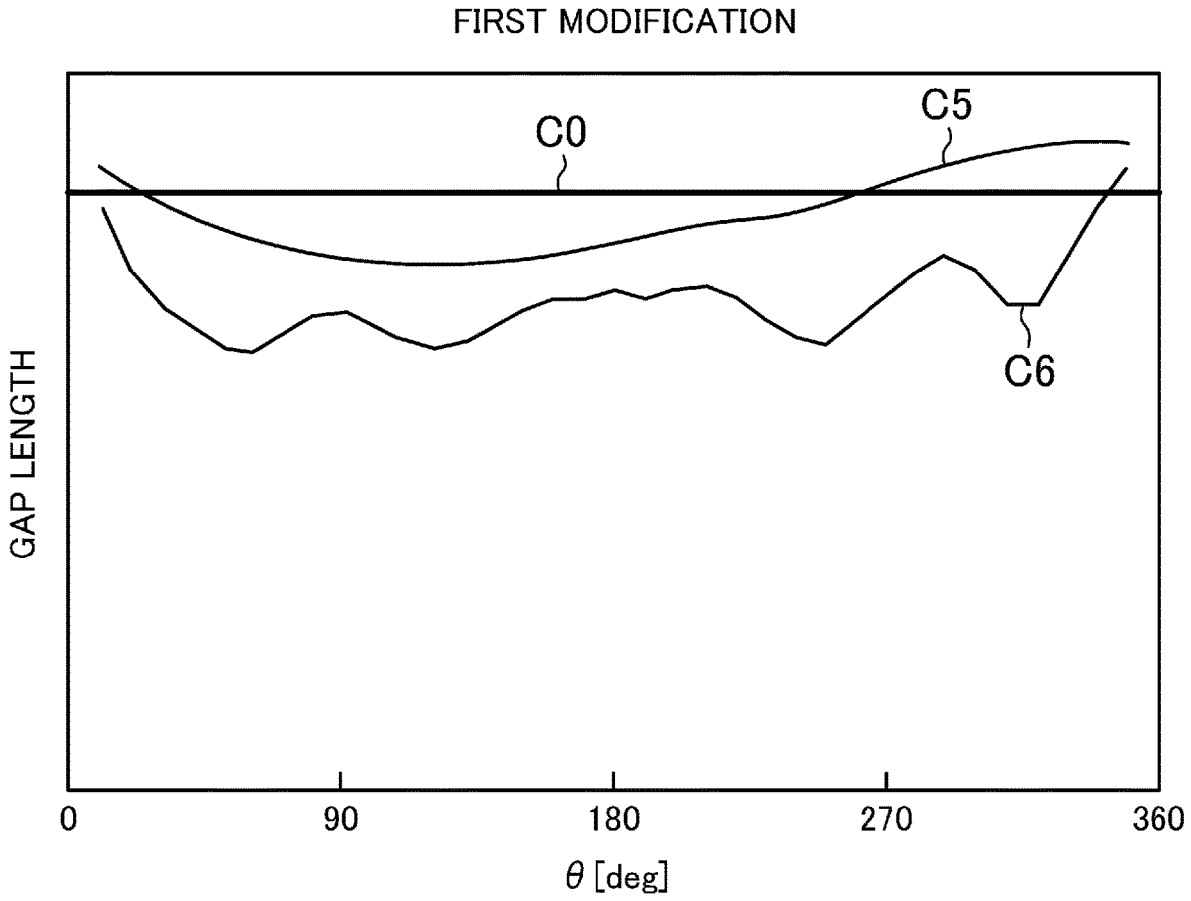
FIG. 13 is a graph showing variation in a gap length in a compression mechanism according to a first modification of the first embodiment.

FIG. 13 shows variation in the gap length in a compression mechanism (hereinafter referred to as "a compression mechanism (40) according to a first modification") in which the narrow groove (80) is provided to only the cylinder head member (61, 62). As illustrated in FIG. 13, the variation in the gap length (C5, C6) in the compression mechanism (40)

according to the first modification is smaller than that in the first comparative example (FIG. 8) and the second comparative example (FIG. 10).

<Compression Mechanism According to Second Modification>

Figure 14:
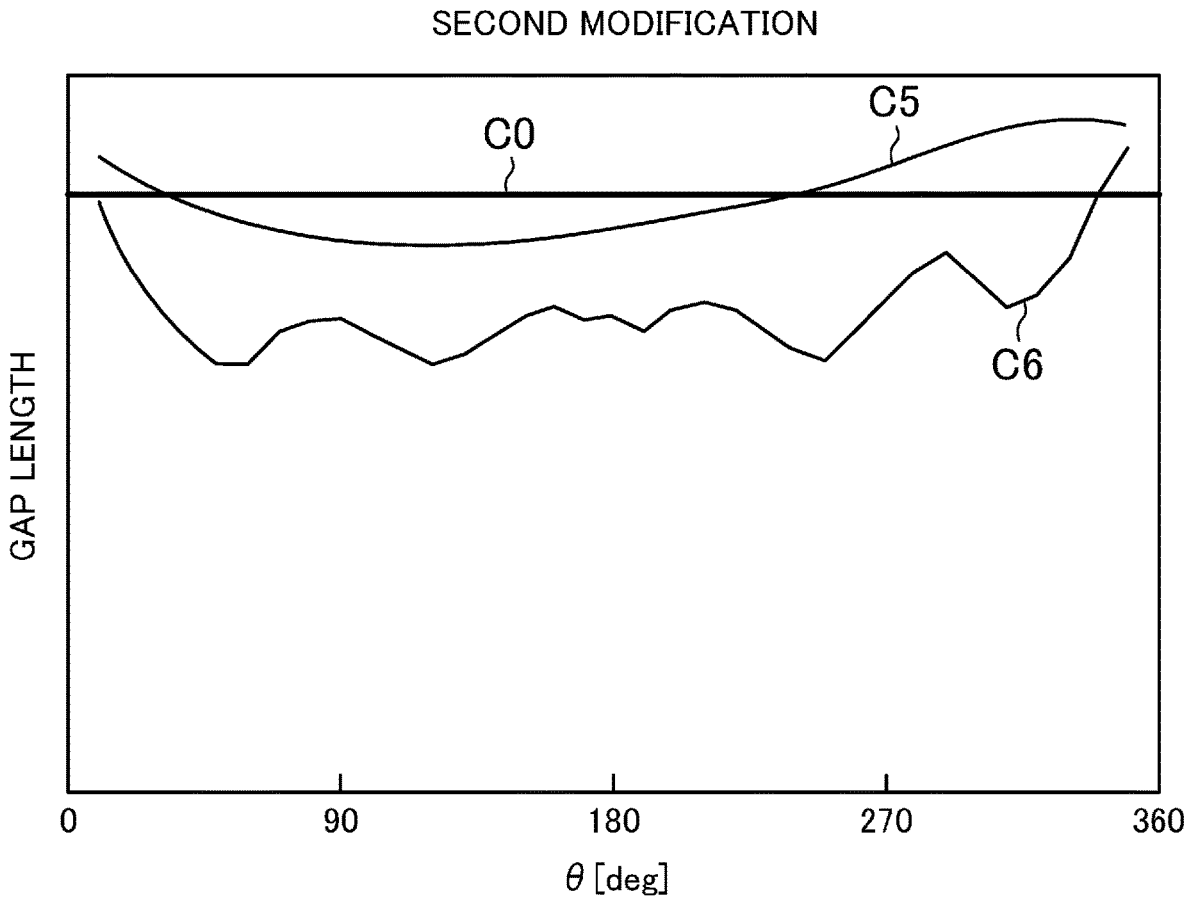
FIG. 14 is a graph showing variation in a gap length in a compression mechanism according to a second modification of the first embodiment.

FIG. 14 shows variation in the gap length in a compression mechanism (hereinafter referred to as "a compression mechanism (40) according to a second modification") in which the narrow groove (80) is provided to only the first cylinder (51). As illustrated in FIG. 14, the variation in the gap length (C5, C6) in the compression mechanism (40) according to the second modification is smaller than that in the first comparative example (FIG. 8) and the second comparative example (FIG. 10).

<Comparison Between First Modification and Second Modification>

A comparison between the compression mechanism (40) according to the first modification and the compression mechanism (40) according to the second modification shows that the variation in the gap lengths (C5, C6) in the compression mechanism (40) according to the first modification (FIG. 13) is smaller than that in the gap lengths (C5, C6) in the compression mechanism (40) according to the second modification (FIG. 14). That is to say, variation in the gap length between the cylinder head member (61, 62) and the first piston (52) can be reduced more effectively in the case where the narrow groove (80) is provided to only the cylinder head member (61, 62) than in the case where the narrow groove (80) is provided to only the first cylinder (51).

[Advantages of First Embodiment]

As can be seen from the foregoing, the narrow groove (80) is provided to at least one of the lower end face (the other axial end face) of the first cylinder head member (61), or the upper end face (the one axial end face) of the first cylinder (51) (in particular, the lower end of the first cylinder head member (61)). This allows the narrow groove (80) to absorb the deformation in the bolted position, and the deformation in the bolted position is less likely to be transmitted to the region inside of the narrow groove (80) (the side closer to the center of the first cylinder (51) than the narrow groove (80) is). This can reduce the deformation in the center portion (the portion facing the first piston (52)) of the first cylinder head member (61), thereby making it possible to reduce the variation in the gap length between the first cylinder head member (61) and the first piston (52) due to bolting.

Further, the narrow groove (80) is provided to both the lower end face of the first cylinder head member (61) and the upper end face of the first cylinder (51). This configuration can improve a deformation absorption effect (an effect of absorbing the deformation in the bolted position) of the narrow groove (80) more significantly than in the case where the narrow groove (80) is provided to only the lower end face of the first cylinder head member (61), or the upper end face of the first cylinder (51). As a result, the deformation in the bolted position is much less likely to be transmitted toward the inner periphery (to a region inside of the narrow groove (80)). This can further reduce the variation in the gap length between the first cylinder head member (61) and the first piston (52) due to bolting.

Allowing the first and second narrow grooves (81, 82) to overlap with each other when viewed in plan makes it possible to substantially prevent the deformation in the bolted position from being transmitted between the first narrow groove (81) and the second narrow groove (82) toward the inner periphery. Thus, the deformation in the bolted position can be properly absorbed by the narrow groove (80), thereby making it possible to properly reduce the deformation in the center portion (the portion facing the first piston (52)) of the first cylinder head member (61). As a result, the variation in the gap length between the first cylinder head member (61) and the first piston (52) due to bolting can be reduced properly. The first narrow groove (81) does not have to be formed so as to overlap with the second narrow groove (82) when viewed in plan.

The description of advantages of the first cylinder head member (61) and the first cylinder (51) can also be applied to the second cylinder head member (62) and the first cylinder (51). That is to say, the narrow groove (80) is provided to at least one of the upper end face (the one axial end face) of the second cylinder head member (62), or the lower end face (the other axial end face) of the first cylinder (51) (in particular, the upper end face of the second cylinder head member (62)), thereby making it possible to reduce the variation in the gap length between the second cylinder head member (62) and the first piston (52) due to bolting. Further, the narrow groove (80) is provided to both the upper end face of the second cylinder head member (62), and the lower end face of the first cylinder (51). Thus, the variation in the gap length between the second cylinder head member (62) and the first piston (52) due to bolting can be reduced more significantly in this case than in the case where the narrow groove (80) is provided to only the upper end face of the second cylinder head member (62), or the lower end face of the first cylinder (51). Allowing the third and fourth narrow grooves (83, 84) to overlap with each other when viewed in plan makes it possible to properly reduce the variation in the gap length between the second cylinder head member (62) and the first piston (52) due to bolting. The third narrow groove (83) does not have to overlap with the fourth narrow groove (84) when viewed in plan.

As can be seen from the foregoing, the variation in the gap length between the cylinder head member (61, 62) and the first piston (52) due to bolting can be reduced, and the gap length between the cylinder head member (61, 62) and thus, the first piston (52) can be provided, properly.

Also, as illustrated in FIG. 2, making the groove width (W) of the narrow groove (80) shorter than the groove depth (D) of the narrow groove (80) allows a region of the first cylinder (51) located outside the narrow groove (80) (a side further from the first cylinder (51) than the narrow groove (80) is, i.e., an area of a surface to which a compression force produced by bolting is applied) to have a larger area than in the case where the groove width (W) of the narrow groove (80) is longer than the groove depth (D) of the narrow groove (80). This can reduce the amount of deformation in the bolted position. Therefore, the amount of the deformation in the center of the cylinder head member (61, 62) can be reduced, too, and as a result, the variation in the gap length between the cylinder head member (61, 62) and the first piston (52) can be reduced.

As illustrated in FIG. 3, the narrow groove (80) is formed in the upper end face (the one axial end face) of the first cylinder (51) so as not to overlap with the first suction port (51*a*) of the first cylinder (51) when viewed in plan. This can avoid formation of the narrow groove (80) at a portion where the first suction port (51*a*) of the first cylinder (51) is formed (i.e., a low-rigidity portion). This can provide the first cylinder (51) with strength. Likewise, the narrow groove (80) is formed in the lower end face (the other axial end face) of the first cylinder (51) so as not to overlap with the first suction port (51*a*) of the first cylinder (51), thereby making it possible to provide the first cylinder (51) with a strength.

As illustrated in FIG. 4, the narrow groove (80) is formed in the lower end face (the other axial end face) of the first cylinder head member (61) so as not to overlap with the first discharge port (61*a*) of the first cylinder head member (61) when viewed in plan. This can avoid formation of the narrow groove (80) at a portion where the first discharge port (61*a*) of the first cylinder head member (61) is formed (i.e., a low-rigidity portion). This can provide the cylinder head member (61) with strength.

As the distance between the bolted position and the narrow groove (80) decreases, a compression force acting on the vicinity of the narrow groove (80) (the deformation force in the same direction as the direction of compressing and deforming the first cylinder (51)) tends to increase. As the distance between the bolted position and the narrow groove (80) increases (i.e., as the bolted position becomes closer to the outer periphery of the first cylinder (51)), the difference between the amount of compression and deformation in the portion near the outer periphery of the first cylinder (51) and the amount of compression and deformation in the portion of the first cylinder (51) near the narrow groove (80) tends to increase, and a separating force acting on the portion near the narrow groove (80) (a force trying to cause axially outward deformation) also tends to increase.

In the compression mechanism (40) according to the first embodiment, the plurality of fastening bolts (70) are disposed on the center line between the narrow groove (80) and the outer circumference of the first cylinder (51) when viewed in plan. This can properly reduce both the compression force and the separating force that act on the portion near the narrow groove (80) to properly reduce the deformation amount in the portion near the narrow groove (80). This can properly reduce the deformation amount in the center portion of the cylinder head member (61, 62), and further properly reduce the variation in the gap length between the cylinder head member (61, 62) and the first piston (52). The narrow groove (80) does not have to be formed such that the plurality of fastening bolts (70) are disposed on the center line between the narrow groove (80) and the outer circumference of the first cylinder (51) when viewed in plan.

Second Embodiment

Figure 15:
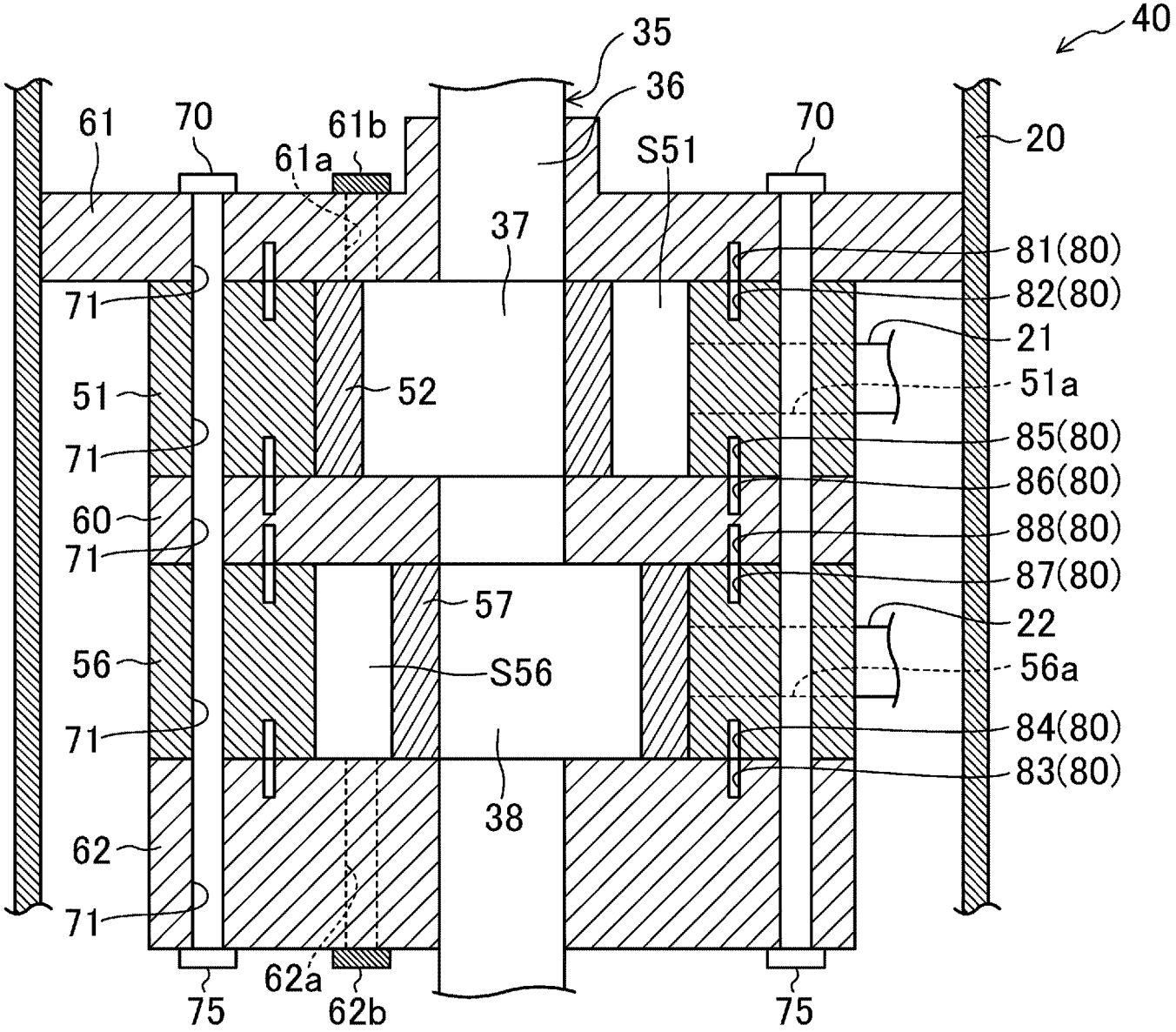
FIG. 15 is a vertical cross-sectional view illustrating main parts of a compressor according to a second embodiment.

A compressor (10) according to a second embodiment includes a compression mechanism (40) illustrated in FIG. 15 instead of the compression mechanism (40) illustrated in FIG. 1. In this example, the body of the casing (20) is provided with a second suction pipe (22) in addition to the first suction pipe (21). The second suction pipe (22) passes through the body of the casing (20) to be connected to the compressor mechanism (40). In this example, the drive shaft (35) includes, in addition to the main shaft (36) and the first eccentric portion (37), a second eccentric portion (38). The second eccentric portion (38) is axially aligned with the first eccentric portion (37), in a portion of the main shaft (36) where the main shaft (36) passes through the compression mechanism (40). In this example, the second eccentric portion (38) is disposed below the first eccentric portion (37). The second eccentric portion (38) is formed in a cylindrical-column shape with a diameter larger than that of the main shaft (36), and the axial center of the second eccentric portion (38) is eccentric from the axial center of the main shaft (36). The eccentric direction of the first eccentric portion (37) and the eccentric direction of the second eccentric portion (38) are shifted from each other by 180° with the axial center of the main shaft (36) as the center. Except these components, the configuration for the compressor (10) of the second embodiment is the same as, or similar to, that for the compressor (10) of the first embodiment.

[Compression Mechanism]

The compression mechanism (40) according to the second embodiment is configured to compress fluids that have been sucked from the first and second suction pipes (21, 22). Specifically, the compression mechanism (40) includes a first cylinder (51), a first piston (52), a second cylinder (56), a second piston (57), a middle plate (60), a first cylinder head member (61), a second cylinder head member (62), and a plurality of fastening bolts (70). In this compression mechanism (40), the first cylinder head member (61), the first cylinder (51), the middle plate (60), the second cylinder (56), and the second cylinder head member (62) are sequentially disposed from top to bottom (from one end to the other end in an axial direction). That is to say, the middle plate (60) is disposed between the first cylinder (51) and the second cylinder head member (62), and the second cylinder (56) is disposed between the middle plate (60) and the second cylinder head member (62).

Also, in this compression mechanism (40), the first cylinder (51), the first piston (52), the first cylinder head member (61), and the middle plate (60) constitute one compression mechanism. The second cylinder (56), the second piston (57), the second cylinder head member (62), and the middle plate (60) constitute another compression mechanism.

<Middle Plate>

The middle plate (60) is disposed between the first cylinder (51) and the second cylinder (56) to cover the lower end face (the other axial end face) of the first cylinder (51) and the upper end face (the one axial end face) of the second cylinder (56). Specifically, the middle plate (60) is disk-shaped, and covers the lower end of the first cylinder (51) and the upper end of the second cylinder (56). The middle plate (60) has flat end faces at its both axial ends.

<Second Cylinder and Second Piston>

Just like the first cylinder (51), a second cylinder chamber (S56) is formed in the second cylinder (56). Specifically, the second cylinder (56) is ring-shaped, and the interior space thereof constitutes the second cylinder chamber (S56). The second cylinder (56) has flat end faces at its both axial ends. In the second cylinder chamber (S56), the second eccentric portion (38) of the drive shaft (35) is disposed. The second cylinder (56) is provided with a second suction port (56*a*). The second suction port (56*a*) radially passes through the second cylinder (56) to communicate with the second cylinder chamber (S56). A second suction pipe (22) is inserted into, and fixed to, the second suction port (56*a*).

Just like the first piston (52), the second piston (57) is disposed in the second cylinder chamber (S56) of the second cylinder (56), and is configured to rotate eccentrically in the interior of the second cylinder (56) (i.e., in the second cylinder chamber (S56)). Specifically, the second piston (57) is cylindrically-shaped, and the second eccentric portion (38) is slidably fitted to the inner periphery of the second piston (57). With this configuration, rotation of the drive shaft (35) allows the second piston (57) to rotate eccentrically in the second cylinder chamber (S56), and as a result, the fluid sucked into the first cylinder chamber (S56) is compressed. The second piston (57) has flat end faces at its both axial ends.

As illustrated in FIG. 3, the second piston (57) is integrally provided with a second blade (58). The second blade (58) radially extends outwardly from the outer periphery of the second piston (57) to divide the second cylinder chamber (S56) into a low pressure side and a high pressure side. Also, the second cylinder (56) is provided with a second bush groove (56*b*). The second bush groove (56*b*) is circular-shaped when viewed in plan. The second bush groove (56*b*) houses a pair of second bushes (59) therein. The pair of the second bushes (59) each have a half-moon shape when viewed in plan. The pair of the second bushes (59) are housed in the second bush groove (56*b*), with the second blade (58) sandwiched therebetween.

<Second Cylinder Head Member>

The second cylinder head member (62) is disposed under the second cylinder (56) (adjacent to the other axial end) to cover the lower end of the second cylinder (56). In this example, the second cylinder head member (62) is cylinder-shaped, and has a bearing hole in its center into which the drive shaft (35) is inserted. The second cylinder head member (62) is provided with a second discharge port (62*a*). The second discharge port (62*a*) axially passes through the second cylinder head member (62) to communicate with the second cylinder chamber (S56) of the second cylinder (56). The second cylinder head member (62) is provided with a second discharge valve (62*b*) opening/closing an outlet of the second discharge port (62*a*). The second discharge valve (62*b*) is comprised of, e.g., a reed valve.

<Fastening Bolt>

The plurality of fastening bolts (70) fasten the first cylinder head member (61), the first cylinder (51), the middle plate (60), the second cylinder (56), and the second cylinder head member (62) together. In this example, the plurality of fastening bolts (70) are circumferentially arranged. Specifically, the plurality of fastening bolts (70) are circumferentially arranged at predetermined intervals, and sequentially pass through an insertion hole (71) provided to the first cylinder head member (61), another insertion hole (71) provided to the outer periphery of the first cylinder (51), yet another insertion hole (71) provided to the middle plate (60), still yet another insertion hole (71) provided to the outer periphery of the second cylinder (56), and a further insertion hole (71) provided to the second cylinder head member (62). The tips of the fastening bolts (70) are fastened to fastening nuts (75).

[Operation of Compressor]

Next, operation of the compressor (10) according to the second embodiment will be described. A low-pressure fluid (for example, a refrigerant evaporated in an evaporator in a refrigerant circuit) flows into the first and second suction pipes (21, 22). The low-pressure fluid that has flowed in the first suction pipe (21) passes through the first suction port (51*a*) of the first cylinder (51), and is sucked into the first cylinder chamber (S51) to be compressed. The fluid that has been compressed in the first cylinder chamber (S51) passes through the first discharge port (61*a*), and flows into a space above the first cylinder head member (61). The low-pressure fluid that has flowed in the second suction pipe (22) passes through the second suction port (56*a*) of the second cylinder (56), and is sucked into the second cylinder chamber (S56) to be compressed. The fluid that has been compressed in the second cylinder chamber (S56) passes through the second discharge port (62*a*), and then, passes through a communication passage (not illustrated) provided to the compression mechanism (40) to flow into a space above the first cylinder head member (61). The high-pressure fluid that has flowed in the space above the first cylinder head member (61) passes through a fluid passage provided to the electric motor (31), and flows into a space above the electric motor (31). Then, the fluid passes through the discharge pipe (25), and is discharged out of the casing (20).

[Narrow Grooves (Protecting Grooves)]

As illustrated in FIG. 15, in this compression mechanism (40), the first cylinder head member (61), the first cylinder (51), the middle plate (60), the second cylinder (56), and the second cylinder head member (62) are each provided with a narrow groove (80). Specifically, the narrow groove (80) is provided to both the lower end face (the other axial end face, i.e., the end face in contact with the first cylinder (51)) of the first cylinder head member (61), and the upper end face (the one axial end face, i.e., the end face in contact with the first cylinder head member (61)) of the first cylinder (51) facing the lower end face of the first cylinder head member (61). The narrow groove (80) is also provided to both the upper end face (the one axial end face, i.e., the end face in contact with the second cylinder (56)) of the second cylinder head member (62), and the lower end face (the other axial end face, i.e., the end face in contact with the second cylinder head member (62)) of the second cylinder (56) facing the upper end face of the second cylinder head member (62). The narrow groove (80) is also provided to both the lower end face (the other axial end face, i.e., the end face in contact with the middle plate (60)) of the first cylinder (51), and the upper end face (the one axial end face, i.e., the end face in contact with the first cylinder (51)) of the middle plate (60) facing the lower end face of the first cylinder (51). The narrow groove (80) is also provided to both the upper end face (the one axial end face, i.e., the end face in contact with the middle plate (60)) of the second cylinder (56), and the lower end face (the other axial end face, i.e., the end face in contact with the second cylinder (56)) of the middle plate (60) facing the upper end face of the second cylinder (56). Each narrow groove (80) is formed to be closer to the inner periphery of the first cylinder (51) (a side closer to the center of the first cylinder (51)) than the fastening bolt (70) is. In this example, the narrow groove (80) extends circumferentially inside with respect to the plurality of fastening bolts (70). The narrow groove (80) has a groove width (W) shorter than its groove depth (D).

In this example, the lower end face of the first cylinder head member (61) is provided with a first narrow groove (81), and the upper end face of the first cylinder (51) is provided with a second narrow groove (82). The upper end face of the second cylinder head member (62) is provided with a third narrow groove (83), and the lower end face of the second cylinder (56) is provided with a fourth narrow groove (84). Furthermore, the lower end face of the first cylinder (51) is provided with a fifth narrow groove (85), and the upper end face of the middle plate (60) is provided with a sixth narrow groove (86). The upper end face of the second cylinder (56) is provided with a seventh narrow groove (87), and the lower end face of the middle plate (60) is provided with an eighth narrow groove (88).

<First and Second Narrow Grooves>

Just like the first embodiment, the first narrow groove (81) provided to the lower end face of the first cylinder head member (61) is formed so as not to overlap with the first discharge port (61*a*) of the first cylinder head member (61) when viewed in plan (see FIG. 4). The second narrow groove (82) provided to the upper end face of the first cylinder (51) is formed so as not to overlap with the first suction port (51*a*) and the first bush groove (51*b*) of the first cylinder (51) when viewed in plan (see FIG. 3). The first and second narrow grooves (81, 82) are formed so as to overlap with each other when viewed in plan.

<Third and Fourth Narrow Grooves>

Just like the first embodiment, the third narrow groove (83) provided to the upper end face of the second cylinder head member (62) is formed so as not to overlap with the second bush groove (56*b*) of the second cylinder (56) when viewed in plan. The fourth narrow groove (84) provided to the lower end face of the second cylinder (56) is formed so as not to overlap with the second suction port (56*a*) and the second bush groove (56*b*) of the second cylinder (56) when viewed in plan (see FIG. 3). The third and fourth narrow grooves (83, 84) are formed so as to overlap with each other when viewed in plan.

<Fifth and Sixth Narrow Grooves>

Just like the second narrow groove (82) provided to the upper end face of the first cylinder (51), the fifth narrow groove (85) provided to the lower end face of the first cylinder (51) is formed so as not to overlap with the first suction port (51*a*) and the first bush groove (51*b*) of the first cylinder (51). Specifically, the fifth narrow groove (85) is C-shaped, i.e., arc-shaped when viewed in plan.

Figure 16:
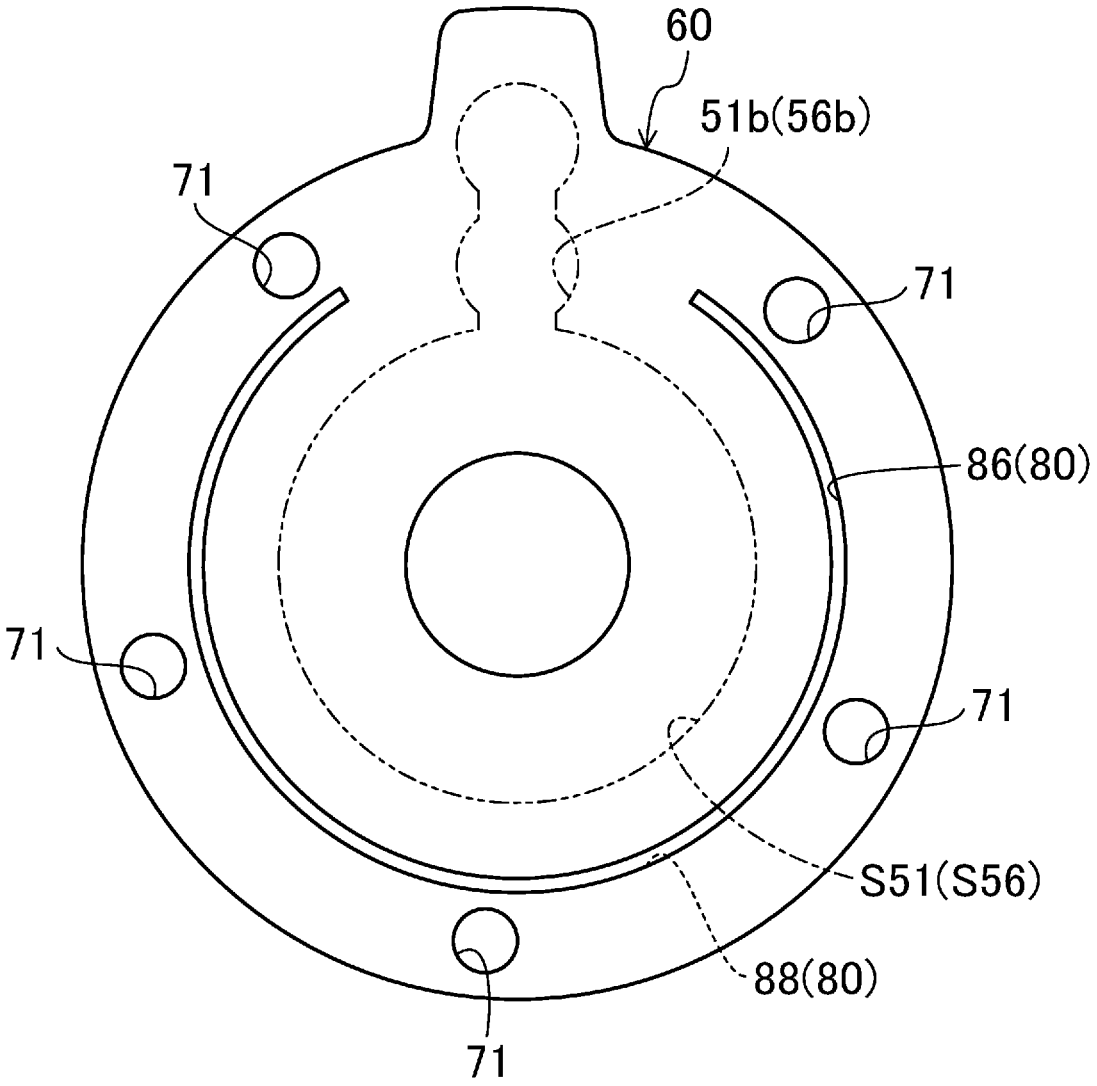
FIG. 16 is a plan view illustrating an exemplary configuration for a middle plate.

As illustrated in FIG. 16, the sixth narrow groove (86) provided to the upper end face of the middle plate (60) is formed so as not to overlap with the first bush groove (51*b*) of the first cylinder (51) when viewed in plan. Specifically, the sixth narrow groove (86) is C-shaped, i.e., arc-shaped when viewed in plan.

The fifth and sixth narrow grooves (85, 86) are formed so as to overlap with each other when viewed in plan. That is to say, the fifth and sixth narrow grooves (85, 86) face each other in the axial direction. Specifically, the radius of the arc-shaped portion of the fifth groove (85) is substantially the same as that of the arc-shaped portion of the sixth narrow groove (86).

<Seventh and Eighth Narrow Grooves>

Just like the fourth narrow groove (84) provided to the lower end face of the second cylinder (56), the seventh narrow groove (87) provided to the upper end face of the second cylinder (56) is formed so as not to overlap with the second suction port (56*a*) and the second bush groove (56*b*) of the second cylinder (56). Specifically, the seventh narrow groove (87) is C-shaped, i.e., arc-shaped.

As illustrated in FIG. 16, the eighth narrow groove (88) provided to the lower end face of the middle plate (60) is formed so as not to overlap with the second bush groove (56*b*) of the second cylinder (56) when viewed in plan. Specifically, the eighth narrow groove (88) is C-shaped, i.e., arc-shaped when viewed in plan.

The seventh and eighth narrow grooves (87, 88) are formed so as to overlap with each other when viewed in plan. That is to say, the seventh and eighth narrow grooves (87, 88) face each other in the axial direction. Specifically, the radius of the arc-shaped portion of the seventh groove (87) is substantially the same as that of the arc-shaped portion of the eighth narrow groove (88).

[Compression Mechanism According to Modifications]

In the above embodiment, the narrow groove (80) is provided to both the lower end face (the other axial end face) of the first cylinder head member (61), and the upper end face (the one axial end face) of the first cylinder (51). Alternatively, the narrow groove (80) may be provided to only the lower end face of the first cylinder head member (61), or the upper end face of the first cylinder (51).

Likewise, in the above embodiment, the narrow groove (80) is provided to both the upper end face (the one axial end face) of the second cylinder head member (62), and the lower end face (the other axial end face) of the seventh cylinder (56). Alternatively, the narrow groove (80) may be provided to only the upper end face of the second cylinder head member (62), or the lower end face of the seventh cylinder (56).

In the above embodiment, the narrow groove (80) is provided to both the lower end face (the other axial end face) of the first cylinder (51), and the upper end face (the one axial end face) of the middle plate (60). Alternatively, the narrow groove (80) may be provided to only the lower end face of the first cylinder (51), or the upper end face of the middle plate (60).

Likewise, in the above embodiment, the narrow groove (80) is provided to both the upper end face (the one axial end face) of the second cylinder (56), and the lower end face (the other axial end face) of the middle plate (60). Alternatively, the narrow groove (80) may be provided to only the upper end face of the second cylinder (56), or the lower end face of the middle plate (60).

[Advantages of Second Embodiment]

As can be seen, the narrow groove (80) is provided to at least one of the lower end face (the other axial end face) of the first cylinder head member (61), or the upper end face (the one axial end face) of the first cylinder (51) (in particular, the lower end face of the first cylinder head member (61)), thereby making it possible to reduce the variation in the gap length between the first cylinder head member (61) and the first piston (52) due to bolting.

Further, the narrow groove (80) is provided to both the lower end face of the first cylinder head member (61), and the upper end face of the first cylinder (51). Thus, the variation in the gap length between the first cylinder head member (61) and the first piston (52) due to bolting can be reduced more significantly in this case than in the case where the narrow groove (80) is provided to only the lower end face of the first cylinder head member (61), or the upper end face of the first cylinder (51).

Allowing the first and second narrow grooves (81, 82) to overlap with each other when viewed in plan makes it possible to properly reduce the variation in the gap length between the first cylinder head member (61) and the first piston (52) due to bolting.

The description of advantages of the first cylinder head member (61) and the first cylinder (51) can also be applied to the second cylinder head member (62) and the second cylinder (56). That is to say, the narrow groove (80) is provided to at least one of the upper end face (the one axial end face) of the second cylinder head member (62), or the lower end face (the other axial end face) of the second cylinder (56) (in particular, the upper end face of the second cylinder head member (62)), thereby making it possible to reduce the variation in the gap length between the second cylinder head member (62) and the second piston (57) due to bolting. Further, the narrow groove (80) is provided to both the upper end face of the second cylinder head member (62), and the lower end face of the second cylinder (56). Thus, the variation in the gap length between the second cylinder head member (62) and the second piston (57) due to bolting can be reduced more significantly in this case than in the case where the narrow groove (80) is provided to only the upper end face of the second cylinder head member (62), or the lower end face of the second cylinder (56). Allowing the third and fourth narrow grooves (83, 84) to overlap with each other when viewed in plan makes it possible to properly reduce the variation in the gap length between the second cylinder head member (62) and the second piston (57) due to bolting. The fifth and sixth narrow grooves (85, 86) are formed so as to overlap with each other when viewed in plan.

The narrow groove (80) can be provided to at least one of the lower end face (the other axial end face) of the first cylinder (51), or the upper end face (the one axial end face) of the middle plate (60). This allows the narrow groove (80) to absorb the deformation in the bolted position, and the deformation in the bolted position is less likely to be transmitted toward the inner periphery (the region inside of the narrow groove (80)). This can reduce the deformation in the center portion (the portion facing the first piston (52)) of the middle plate (60), and the variation in the gap length between the middle plate (60) and the first piston (52) due to bolting.

Further, the narrow groove (80) is provided to both the lower end face of the first cylinder (51), and the upper end face of the middle plate (60). Thus, in this case, the deformation absorption effect of the narrow groove (80) can be improved more significantly, and the variation in the gap length between the middle plate (60) and the first piston (52) due to bolting can be reduced more significantly, than in the case where the narrow groove (80) is provided to only the lower end face of the first cylinder (51), or the upper end face of the middle plate (60).

Allowing the fifth and sixth narrow grooves (85, 86) to overlap with each other when viewed in plan makes it possible to substantially prevent the deformation in the bolted position from being transmitted between the fifth narrow groove (85) and the sixth narrow groove (86) toward the inner periphery. Thus, the deformation in the bolted position can be properly absorbed by the narrow groove (80), thereby making it possible to properly reduce the deformation in the center portion (the portion facing the first piston (52)) of the middle plate (60). As a result, the variation in the gap length between the middle plate (60) and the first piston (52) due to bolting can be reduced properly. The fifth narrow groove (85) does not have to be formed so as to overlap with the sixth narrow groove (86) when viewed in plan.

The description of advantages of the first cylinder (51) and the middle plate (60) can also be applied to the second cylinder (56) and the middle plate (60). That is to say, the narrow groove (80) is provided to at least one of the upper end face (the one axial end face) of the second cylinder (56), or the lower end face (the other axial end face) of the middle plate (60), thereby making it possible to reduce the variation in the gap length between the middle plate (60) and the second piston (57) due to bolting. Further, the narrow groove (80) is provided to both the upper end face of the second cylinder (56), and the lower end face of the middle plate (60). Thus, the variation in the gap length between the middle plate (60) and the second piston (57) due to bolting can be reduced more significantly in this case than in the case where the narrow groove (80) is provided to only the upper end face of the second cylinder (56), or the lower end face of the middle plate (60). Allowing the seventh and eighth narrow grooves (87, 88) to overlap with each other when viewed in plan makes it possible to properly reduce the variation in the gap length between the middle plate (60) and the second piston (57) due to bolting. The seventh narrow groove (87) does not have to be formed so as to overlap with the eighth narrow groove (88) when viewed in plan.

(First Modification of Narrow Groove)

Figure 17:
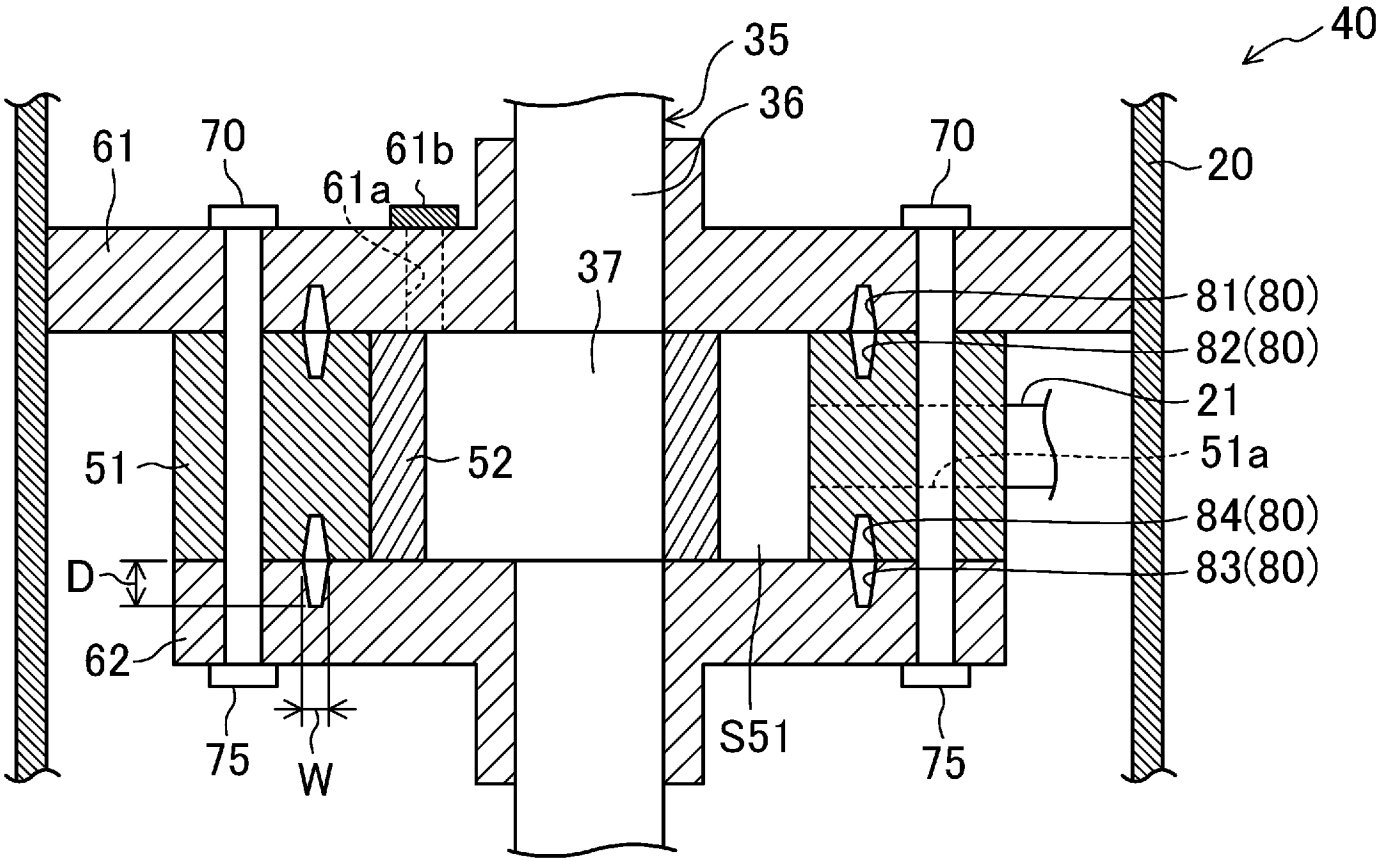
FIG. 17 is a vertical cross-sectional view illustrating a first modification of narrow grooves.

As illustrated in FIG. 17, the narrow groove (80) may be formed such that the groove width (W) becomes gradually shorter toward the bottom. The maximum width of the groove width (W) (the groove width (X) at the open end) is shorter than that of the groove depth (D).

The above-described configuration allows for easily forming the narrow groove (80) in the components (e.g., the cylinder head member (61, 62) and the first cylinder (51)) forming the compression mechanism (40). For example, the component having the narrow groove (80) formed therein can be easily removed from a metal mold. As a result, the components forming the compression mechanism (40) can be manufactured easily.

(Second Modification of Narrow Groove)

Figure 18:
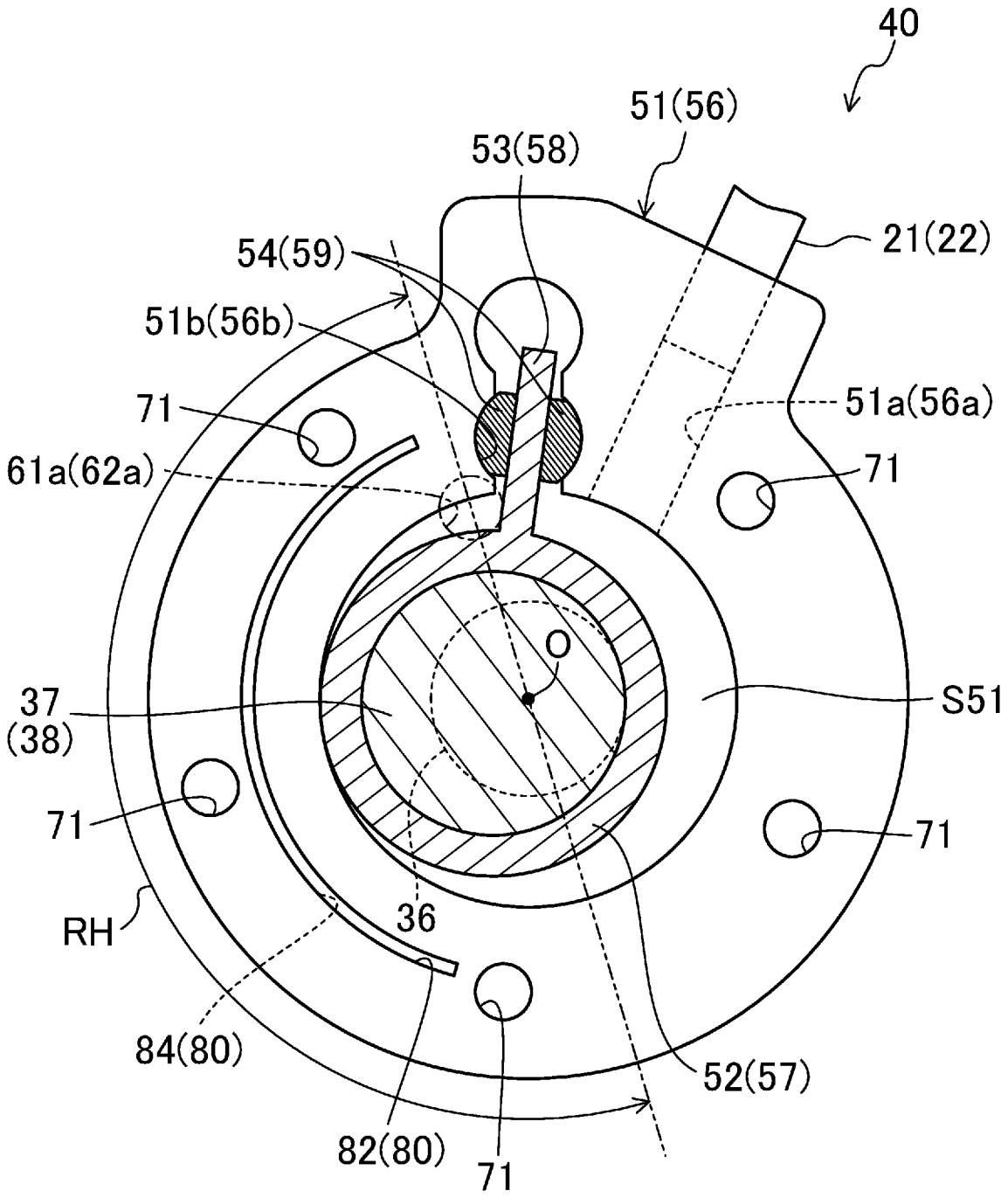
FIG. 18 is a plan view illustrating a second modification of the narrow grooves.
Figure 19:
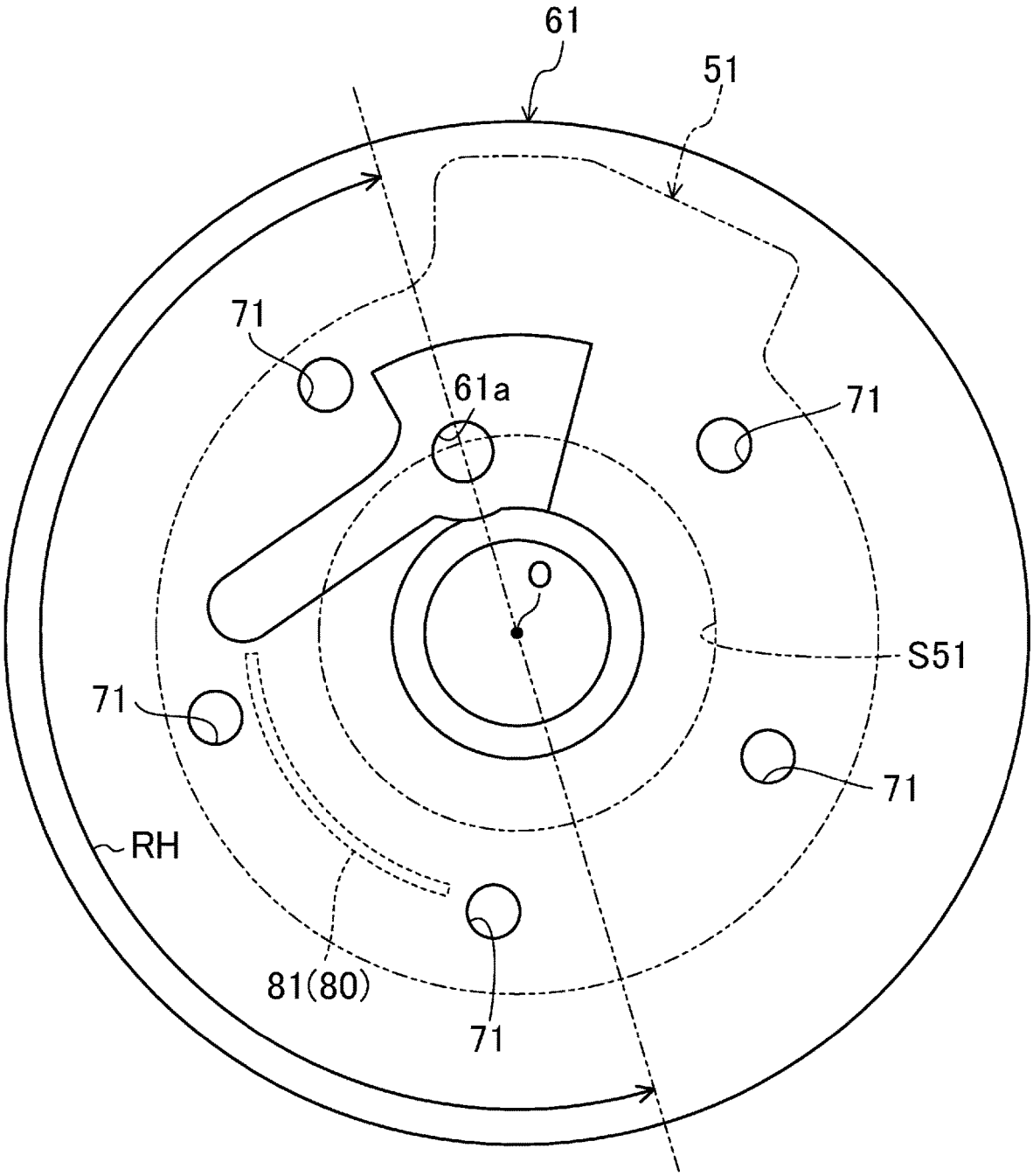
FIG. 19 is a plan view illustrating the second modification of the narrow grooves.

As illustrated in FIGS. 18 and 19, the narrow groove (80) may be formed in only a high-pressure region (RH). The high-pressure region (RH) refers to a region ranging from the position of the first or second discharge port (61*a*, 62*a*) to a position on an opposite side of the center of the first or second cylinder (51, 56) from the first or second discharge port (61*a*, 62*a*) (a position advanced by 180° from the first or second discharge port (61*a*, 62*a*) with the center of the first or second cylinder (51, 56) as an axis) along a direction opposite the rotation direction of the first or second piston (52, 57) (the counterclockwise direction in FIGS. 18 and 19).

Specifically, in the compression mechanism (40) of the first embodiment, the narrow grooves (80) provided to the axial end faces of the first cylinder (51) and the end faces, being in contact with the first cylinder (51), of the first and second cylinder head members (61, 62) may be formed in only the high pressure region (RH) ranging from the position of the first discharge port (61*a*) to the position on the opposite side of the center of the first cylinder (51) from the first discharge port (61*a*) along the direction opposite the rotation direction of the first piston (52). Specifically, in the compression mechanism (40) of the second embodiment, the narrow grooves (80) provided to the axial end faces of the first cylinder (51) and the end face, being in contact with the first cylinder (51), of the first cylinder head member (61) may be formed in only the high pressure region (RH) ranging from the position of the first discharge port (61*a*) to the position on the opposite side of the center of the first cylinder (51) from the first discharge port (61*a*) along the direction opposite the rotation direction of the first piston (52). Also, the narrow grooves (80) provided to the axial end faces of the second cylinder (56) and the end face, being in contact with the second cylinder (56), of the second cylinder head member (62) may be formed in only the high pressure region (RH) ranging from the position of the second discharge port (62*a*) to the position on the opposite side of the center of the second cylinder (56) from the second discharge port (62*a*) along the direction opposite the rotation direction of the second piston (57).

With the configuration described above, the narrow grooves (80) are formed in the high pressure region (RH), and thus, the variation in the gap length between the first cylinder head member (61) and the first piston (52) due to bolting can be reduced in the high pressure region (RH). Also, no narrow groove (80) is formed in a low pressure region (i.e., a region ranging from the position of the first or second discharge port (61*a*, 62*a*) to a position on an opposite side of the center of the first or second cylinder (51, 56) from the first or second discharge port (61*a*, 62*a*) along the rotation direction of the first or second piston (52, 57)). Thus, this can reduce an average increase in the gap length between the first cylinder head member (61) and the first piston (52) caused by the formation of the narrow groove (80) in the low pressure region. In the high pressure region (RH), contact between the first cylinder head member (61) and the first piston (52) is more likely to occur than in the low pressure region. In the low pressure region, lubricant (refrigerating machine oil) is more likely to be leaked from the interior of the first piston (52) toward the interior of the first cylinder (51) through the gap between the first cylinder head member (61) and the first piston (52) than in the high pressure region (RH).

Accordingly, providing the narrow groove (80) to only the high pressure region (RH) can reduce the variation in the gap length between the first cylinder head member (61) and the first piston (52) due to bolting in the high pressure region (RH). This can effectively reduce contact between the first cylinder head member (61) and the first piston (52) in the high pressure region (RH). The average increase in the gap length between the first cylinder head member (61) and the first piston (52) caused by the formation of the narrow groove (80) in the low pressure region can be reduced, enabling effective reduction of leakage of the lubricant (refrigerating machine oil) through the gap between the first cylinder head member (61) and the first piston (52) in the low pressure region.

In the compression mechanism (40) of the first embodiment, the description of advantages of the first cylinder head member (61) and the first cylinder (51) can be applied to the second cylinder head member (62) and the first cylinder (51). That is to say, providing the narrow groove (80) to only the high pressure region (RH) can effectively reduce the contact between the second cylinder head member (62) and the first piston (52) in the high pressure region (RH). On top of that, this also can effectively reduce leakage of the lubricant (refrigerating machine oil) passing through the gap between the second cylinder head member (62) and the first piston (52) in the low pressure region.

In the compression mechanism (40) of the second embodiment, the description of advantages of the first cylinder head member (61) and the first cylinder (51) can also be applied to the second cylinder head member (62) and the second cylinder (56). That is to say, providing the narrow groove (80) to only the high pressure region (RH) can effectively reduce the contact between the second cylinder head member (62) and the second piston (57) in the high pressure region (RH). On top of that, this also can effectively reduce leakage of the lubricant (refrigerating machine oil) passing through the gap between the second cylinder head member (62) and the second piston (57) in the low pressure region.

(Third Modification of Narrow Groove)

Figure 20:
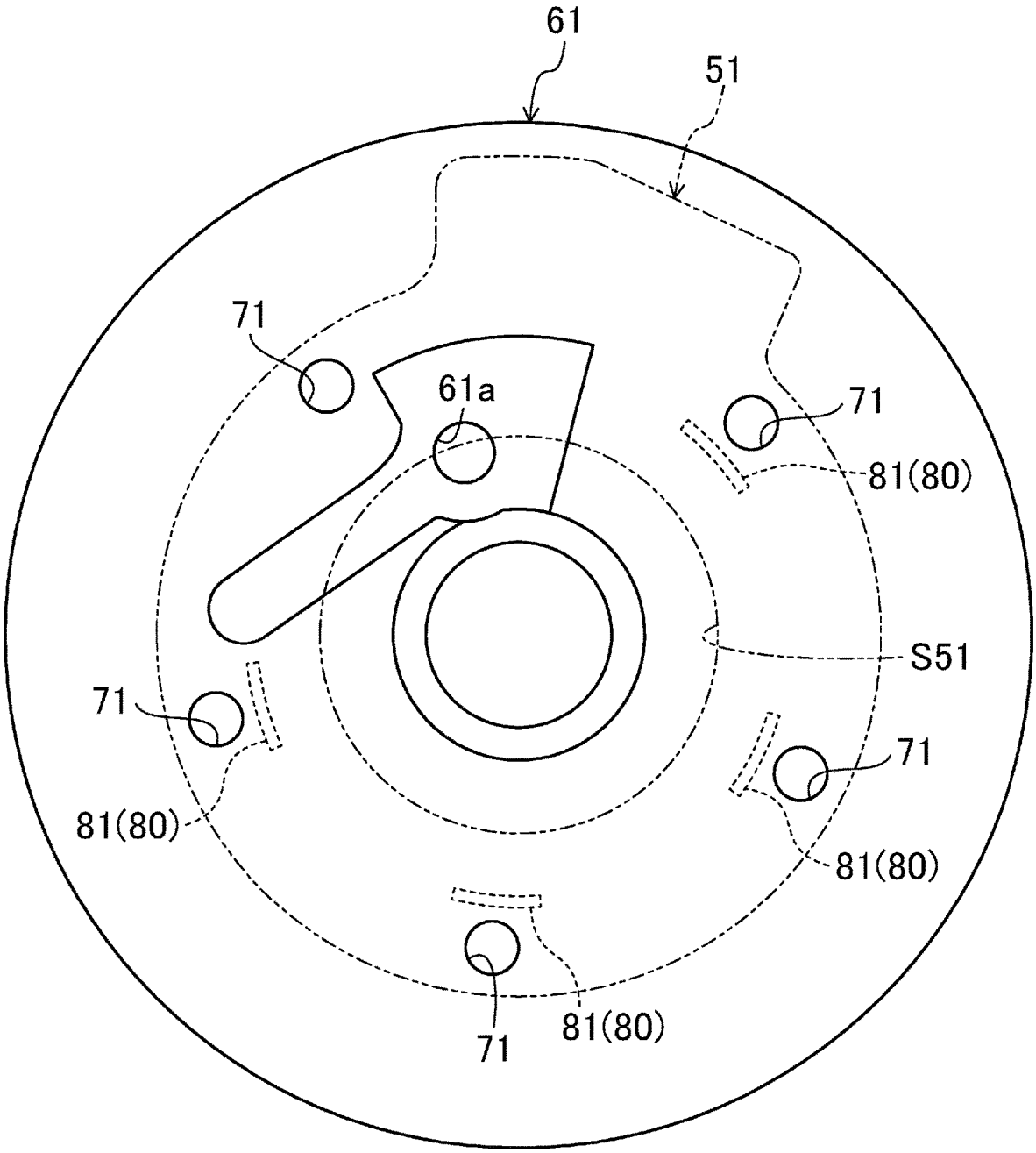
FIG. 20 is a plan view illustrating a third modification of the narrow grooves.

The narrow grooves (80) may be continuously provided as illustrated in FIGS. 3, 4, 5, and 16, or may be intermittently provided as illustrated in FIG. 20. In FIG. 20, the narrow groove (80) is provided to only a portion near the fastening bolt (70). In the configuration as illustrated in FIG. 20, deformation in the bolted position can be absorbed by the narrow groove (80). Thus, the deformation in the bolted position can be less likely to be transmitted to the region inside of the narrow groove (80) (to the side closer to the center of the first cylinder (51) than the narrow groove (80) is).

Other Embodiments

In the above description, the cylinder head member closer to the electric motor (31) is denoted as the first cylinder head member (61), and the cylinder head member away from the electric motor (31) is denoted as the second cylinder head member (62). Alternatively, the cylinder head member closer to the electric motor (31) may be denoted as the second cylinder head member (62), and the cylinder head member away from the electric motor (31) may be denoted as the first cylinder head member (61).

In the above embodiments, the compressor (10) is disposed such that the axial direction of the casing (20) is oriented to the vertical direction. Alternatively, the compressor (10) may be disposed such that the axial direction of the casing (20) is oriented to the horizontal direction.

Also, the plurality of fastening bolts (70) may be arranged in one imaginary circle (for example, an imaginary circle with the center of the first cylinder (51) as an axis) when viewed in plan, as illustrated in FIG. 3. Alternatively, they do not have to be arranged in one imaginary circle when viewed in plan, as illustrated in FIG. 18. That is to say, the distances from the center of the first cylinder (51) to the plurality of fastening bolts (70) may be the same or different from one another.

Moreover, the above embodiments and modifications may be worked appropriately in combination. Note that the foregoing description of the embodiments and the modifications is a merely preferable example in nature, and is not intended to limit the scope, application, or uses of the present disclosure.

INDUSTRIAL APPLICABILITY

As can be seen from the foregoing description, the above-described compressor is useful as, e.g., a compressor provided to a refrigerant circuit performing a refrigeration cycle.

What is claimed is:

1. A compressor comprising:

a compression mechanism including a ring-shaped first cylinder;

a first piston eccentrically rotatable in an interior of the first cylinder;

a first cylinder head member disposed adjacent to one axial end of the first cylinder;

a second cylinder head member disposed adjacent to an other axial end of the first cylinder; and a fastening bolt fastening the first cylinder head member, the first cylinder, and the second cylinder head member together, an end face of the first cylinder head member contacting the first cylinder, and the end face being provided with a protecting groove, the protecting groove being formed closer to a center of the first cylinder than the fastening bolt, and the protecting groove having a groove width smaller than a groove depth thereof, an other protecting groove being also provided in one axial end face of the first cylinder, the first cylinder being provided with a first suction port radially passing through the first cylinder, and the other protecting groove provided in the one axial end face of the first cylinder being formed so as not to overlap with the first suction port, when viewed in a plan view.

2. The compressor of claim 1, wherein the protecting groove provided in the end face of the first cylinder head member contacting the first cylinder is formed so as to overlap with the other protecting groove provided in the one axial end face of the first cylinder, when viewed in a plan view.

3. The compressor of claim 2, wherein
an other protecting groove is also provided in at least one of
an end face of the second cylinder head member contacting the first cylinder, and
the other axial end face of the first cylinder.

4. The compressor of claim 2, wherein
the compression mechanism further includes
a middle plate disposed adjacent to the other axial end of the first cylinder,
a ring-shaped second cylinder disposed between the middle plate and the second cylinder head member, and
a second piston eccentrically rotatable in an interior of the second cylinder,
the fastening bolt fastens the first cylinder head member, the first cylinder, the middle plate, the second cylinder, and the second cylinder head member together, and
an other protecting groove is also provided in at least one of
an end face of the second cylinder head member contacting the second cylinder, and
the other axial end face of the second cylinder.

5. The compressor of claim 4, wherein
an other protecting groove is also provided in at least one of
the other axial end face of the first cylinder, and
an end face of the middle plate contacting the first cylinder, and
an other protecting groove is also provided in at least one of
one axial end face of the second cylinder, and
an end face of the middle plate contacting the second cylinder.

6. The compressor of claim 1, wherein
an other protecting groove is also provided in at least one of
an end face of the second cylinder head member contacting the first cylinder, and
the other axial end face of the first cylinder.

7. The compressor of claim 1, wherein
the compression mechanism further includes
a middle plate disposed adjacent to the other axial end of the first cylinder,
a ring-shaped second cylinder disposed between the middle plate and the second cylinder head member, and
a second piston eccentrically rotatable in an interior of the second cylinder,
the fastening bolt fastens the first cylinder head member, the first cylinder, the middle plate, the second cylinder, and the second cylinder head member together, and
an other protecting groove is also provided in at least one of
an end face of the second cylinder head member contacting the second cylinder, and
the other axial end face of the second cylinder.

8. The compressor of claim 7, wherein
an other protecting groove is also provided in at least one of
the other axial end face of the first cylinder, and
an end face of the middle plate contacting the first cylinder, and
an other protecting groove is also provided in at least one of
one axial end face of the second cylinder, and
an end face of the middle plate contacting the second cylinder.

9. The compressor of claim 1, wherein
the first cylinder head member is provided with a first discharge port axially passing through the first cylinder head member, and
the protecting groove provided in the end face of the first cylinder head member contacting the first cylinder is formed so as not to overlap with the first discharge port, when viewed in a plan view.

10. The compressor of claim 1, wherein
the protecting groove is gradually tapered toward a bottom such that the groove width becomes gradually smaller toward the bottom.

11. The compressor of claim 1, wherein
the protecting groove is formed so as to extend circumferentially, and
the fastening bolt is disposed on a center line between the protecting groove and an outer circumference of the first cylinder, when viewed in a plan view.

12. The compressor of claim 1, wherein
the first cylinder head member is provided with a first discharge port axially passing through the first cylinder head member, and
the protecting groove is provided in only a high-pressure region ranging from a position of the first discharge port to a position on an opposite side of a center of the first cylinder from the first discharge port along a direction opposite a rotation direction of the first piston.

13. A compressor comprising:
a compression mechanism including
a ring-shaped first cylinder;
a first piston eccentrically rotatable in an interior of the first cylinder;
a first cylinder head member disposed adjacent to one axial end of the first cylinder:
a second cylinder head member disposed adjacent to an other axial end of the first cylinder; and
a fastening bolt fastening the first cylinder head member, the first cylinder, and the second cylinder head member together,
an end face of the first cylinder head member contacting the first cylinder, and the end face being provided with a protecting groove,
the protecting groove being formed closer to a center of the first cylinder than the fastening bolt, and the protecting groove having a groove width smaller than a groove depth thereof,
the protecting groove being formed so as to extend circumferentially, and
the fastening bolt being disposed on a center line between the protecting groove and an outer circumference of the first cylinder, when viewed in a plan view.

14. A compressor comprising:
a compression mechanism including
a ring-shaped first cylinder;
a first piston eccentrically rotatable in an interior of the first cylinder;
a first cylinder head member disposed adjacent to one axial end of the first cylinder;
a second cylinder head member disposed adjacent to an other axial end of the first cylinder; and
a fastening bolt fastening the first cylinder head member, the first cylinder, and the second cylinder head member together, an end face of the first cylinder head member contacting the first cylinder, and the end face being provided with a protecting groove, the protecting groove being formed closer to a center of the first cylinder than the fastening bolt, and the protecting groove having a groove width smaller than a groove depth thereof, the first cylinder head member being provided with a first discharge port axially passing through the first cylinder head member, and the protecting groove being provided in only a high-pressure region ranging from a position of the first discharge port to a position on an opposite side of a center of the first cylinder from the first discharge port along a direction opposite a rotation direction of the first piston.

* * * * *